US010821757B2

(12) United States Patent
Sugiura et al.

(10) Patent No.: US 10,821,757 B2
(45) Date of Patent: Nov. 3, 2020

(54) LIQUID EJECTION HEAD

(71) Applicant: BROTHER KOGYO KABUSHIKI KAISHA, Nagoya (JP)

(72) Inventors: Keita Sugiura, Toyoake (JP); Masayuki Takata, Nagoya (JP); Hideki Hayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/856,184

(22) Filed: Apr. 23, 2020

(65) Prior Publication Data

US 2020/0247161 A1 Aug. 6, 2020

Related U.S. Application Data

(63) Continuation of application No. 16/514,251, filed on Jul. 17, 2019, now Pat. No. 10,654,301, which is a (Continued)

(30) Foreign Application Priority Data

Jul. 27, 2016 (JP) ..... 2016-147226

(51) Int. Cl.
*B41J 29/377* (2006.01)
*B41J 2/155* (2006.01)
*B41J 2/14* (2006.01)

(52) U.S. Cl.
CPC ..... *B41J 29/377* (2013.01); *B41J 2/1408* (2013.01); *B41J 2/14201* (2013.01); *B41J 2/155* (2013.01);
(Continued)

(58) Field of Classification Search
CPC .... B41J 2/155; B41J 2/14072; B41J 2/14201; B41J 2202/20; B41J 2002/14491
(Continued)

(56) References Cited

U.S. PATENT DOCUMENTS 6,820,959 B1 11/2004 Spitz et al.
7,431,428 B2 10/2008 Yamada
(Continued)

FOREIGN PATENT DOCUMENTS

CN 103381706 A 11/2013
CN 105050814 B 8/2016
(Continued)

OTHER PUBLICATIONS

Extended European Search Report issued in corresponding EP Application No. 17163679.8, dated Oct. 18, 2017.
(Continued)

*Primary Examiner* — An H Do
(74) *Attorney, Agent, or Firm* — Merchant & Gould P.C.

(57) ABSTRACT

A liquid ejection head includes: a first head unit; a second head unit disposed adjacent to the first head unit in a first direction and located on a first side of the first head unit in a second direction; and a heat uniforming unit shared by the first head unit and the second head unit. Each of the first head unit and the second head unit includes: a unit body including an actuator; and a first driver integrated circuit disposed on the first side of the unit body in the second direction. The heat uniforming unit includes a first heat uniforming member disposed on the first side of the first head unit and the second head unit in the second direction. The first heat uniforming member includes a first protrusion located next to the second head unit in the first direction and protruding toward the first head unit.

8 Claims, 16 Drawing Sheets

Related U.S. Application Data continuation of application No. 16/196,501, filed on Nov. 20, 2018, now Pat. No. 10,391,800, which is a continuation of application No. 15/886,951, filed on Feb. 2, 2018, now Pat. No. 10,160,242, which is a continuation of application No. 15/468,524, filed on Mar. 24, 2017, now Pat. No. 9,919,546.

(52) U.S. Cl.
CPC ..... *B41J 2202/08* (2013.01); *B41J 2202/20* (2013.01); *B41J 2202/21* (2013.01)

(58) Field of Classification Search
USPC ..... 347/17, 18, 49, 57–59
See application file for complete search history.

(56) References Cited

U.S. PATENT DOCUMENTS

| | | | |
|---|---|---|---|
| 7,845,773 | B2 | 12/2010 | Hawkins et al. |
| 7,905,570 | B2 | 3/2011 | Ito |
| 9,126,405 | B2 | 9/2015 | Sugiura et al. |
| 9,440,440 | B2 | 9/2016 | Date |
| 9,919,546 | B2 | 3/2018 | Sugiura et al. |
| 2005/0253883 | A1 | 11/2005 | Kato |
| 2006/0170732 | A1 | 8/2006 | Yamada |
| 2013/0293627 | A1 | 11/2013 | Ishii et al. |
| 2015/0174901 | A1 | 6/2015 | Akahane et al. |
| 2015/0224764 | A1 | 8/2015 | Iijima |
| 2016/0052262 | A1 | 2/2016 | Gejima |

FOREIGN PATENT DOCUMENTS

| | | | |
|---|---|---|---|
| DE | 197 43 804 | A1 | 4/1999 |
| EP | 2 979 870 | A1 | 2/2016 |
| JP | 6-155726 | A | 6/1994 |
| JP | 2001-322292 | A | 11/2001 |
| JP | 2005-297554 | A | 10/2005 |
| JP | 2005-324453 | A | 11/2005 |
| JP | 2006-205689 | A | 8/2006 |
| JP | 2007-196479 | A | 8/2007 |
| JP | 2008-062434 | A | 3/2008 |
| JP | 2015-054439 | A | 3/2015 |
| JP | 2015-136921 | A | 7/2015 |
| JP | 2015-150741 | A | 8/2015 |

OTHER PUBLICATIONS

Office Action issued in corresponding Chinese Patent Application No. 201710196319.X, dated Apr. 10, 2020.

Office Action issued in corresponding European Patent Application No. 17163679.8, dated Jul. 10, 2020.

Office Action issued in corresponding Japanese Patent Application No. 2016-147226, dated Aug. 18, 2020.

LIQUID EJECTION HEAD

CROSS REFERENCE TO RELATED APPLICATION

The present application is a continuation of U.S. patent application Ser. No. 16/514,251, filed Jul. 17, 2019, which is a continuation of U.S. patent application Ser. No. 16/196,501, filed Nov. 20, 2018, which is a continuation of U.S. patent application Ser. No. 15/886,951, filed Feb. 2, 2018, which is a continuation of U.S. patent application Ser. No. 15/468,524, filed Mar. 24, 2017, both of which claim priority from Japanese Patent Application No. 2016-147226, filed Jul. 27, 2016, the disclosures of all of which are herein incorporated by reference in their entirety.

BACKGROUND

The following disclosure relates to a liquid ejection head.

There is known a liquid ejection head constituted by a plurality of head units in combination. One example of the liquid ejection head includes a plurality of head units (ink-jet heads) arranged in a main scanning direction, and adjacent two of the head units are different in position in a front and rear direction. In this liquid ejection head, each of the head units includes: a multiplicity of nozzles; an actuator (a piezoelectric element) for ejection of ink from the nozzles; a driver IC for driving the actuator; and a heat sink for dissipating heat generated by the driver IC.

SUMMARY

In the liquid ejection head constituted by the head units in combination, incidentally, a difference in driving manner among the head units causes a difference in amount of heat generated by the driver IC among the head units. In the above-described liquid ejection head, although the heat generated by the driver IC is dissipated by the heat sink in each of the head units, a temperature is different among the driver ICs of the respective head units. If the temperature of the driver IC is different among the head units, a manner of liquid ejection is different among the head units. Thus, unevenness in density occurs on an image recorded on a recording medium, which may result in deterioration of a recording quality.

Accordingly, an aspect of the disclosure relates to a liquid ejection head with less deterioration of a recording quality.

In one aspect of the disclosure, a liquid ejection head includes: a first head unit; a second head unit disposed adjacent to the first head unit in a first direction, the second head unit located on a first side of the first head unit in a second direction orthogonal to the first direction; and a heat uniforming unit shared by the first head unit and the second head unit. Each of the first head unit and the second head unit includes: a unit body including an actuator configured to cause ejection of liquid from a plurality of nozzles; and a first driver integrated circuit disposed on the first side of the unit body in the second direction, the first driver integrated circuit being configured to drive the actuator. The heat uniforming unit includes a first heat uniforming member disposed on the first side of the first head unit and the second head unit in the second direction. The first heat uniforming member includes a first protrusion located next to the second head unit in the first direction, the first protrusion protruding toward the first head unit in a direction directed from the first side toward a second side of the first head unit in the second direction, the first side and the second side being opposite sides of the first head unit in the second direction.

In another aspect of the disclosure, a liquid ejection head includes: a first head unit; a second head unit disposed adjacent to the first head unit in a first direction, the second head unit located on a first side of the first head unit in a second direction orthogonal to the first direction; and a heat uniforming unit shared by the first head unit and the second head unit. Each of the first head unit and the second head unit includes: a unit body including an actuator configured to cause ejection of liquid from a plurality of nozzles; and a first driver integrated circuit disposed on the first side of the unit body in the second direction, the first driver integrated circuit being configured to drive the actuator. The heat uniforming unit includes: a first heat uniforming member disposed on the first side of the first head unit and the second head unit in the second direction; and an intermediate heat uniforming member disposed on the first side of the first head unit in the second direction and disposed on a second side of the second head unit in the second direction, the first side and the second side being opposite sides in the second direction. The first heat uniforming member and the intermediate heat uniforming member are in thermal contact with each other.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

and

Figure 17:
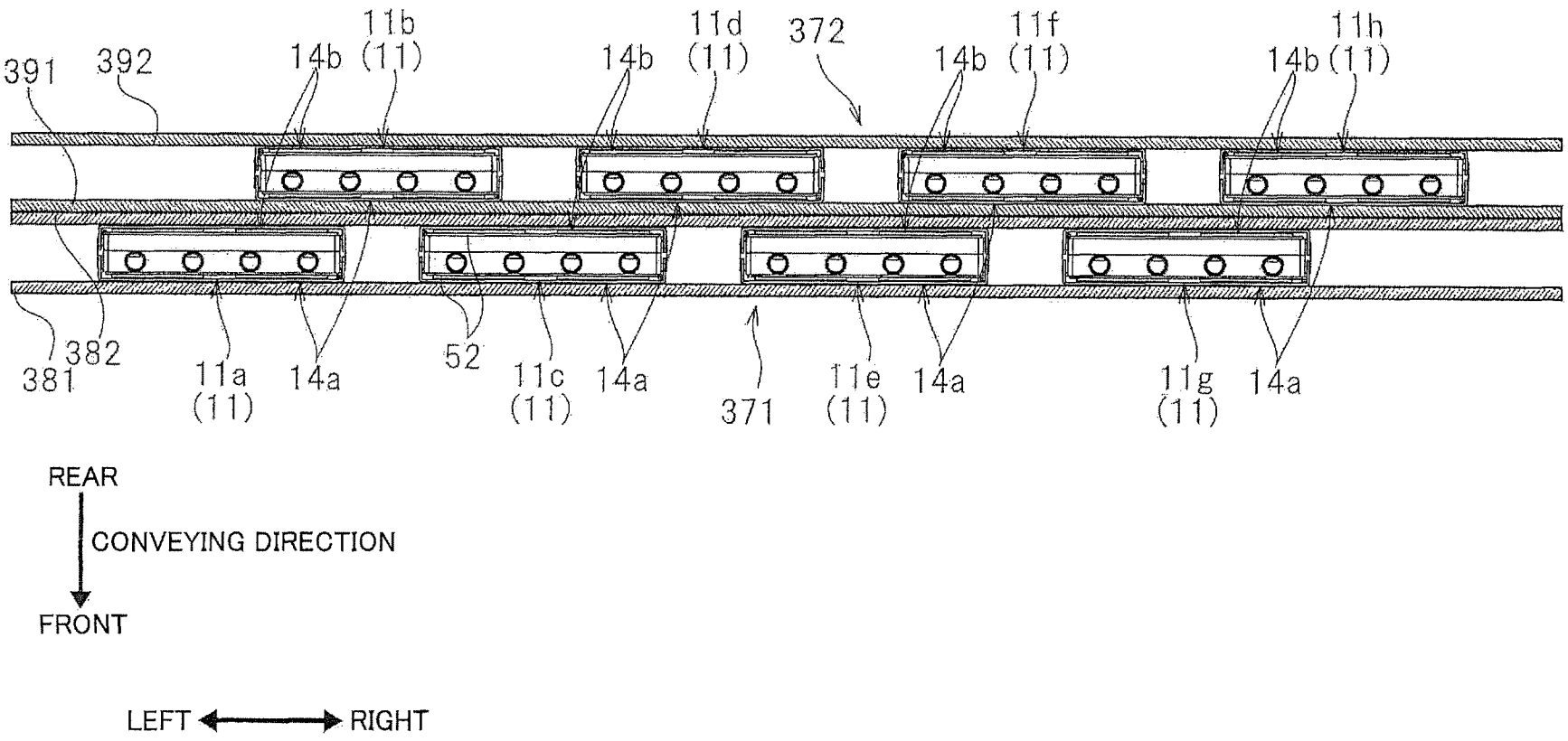

FIG. 17 is a plan cross-sectional view of the common heat sink and the head unit in said still another modification.

DETAILED DESCRIPTION OF THE EMBODIMENT

Hereinafter, there will be described one embodiment by reference to the drawings. The conveying direction in FIG.

1 is defined as the front and rear direction. The direction parallel with the horizontal plane and orthogonal to the conveying direction is defined as the right and left direction. The direction orthogonal to the conveying direction and the right and left direction is defined as the up and down direction.

Overall Configuration of Printer

Figure 1:
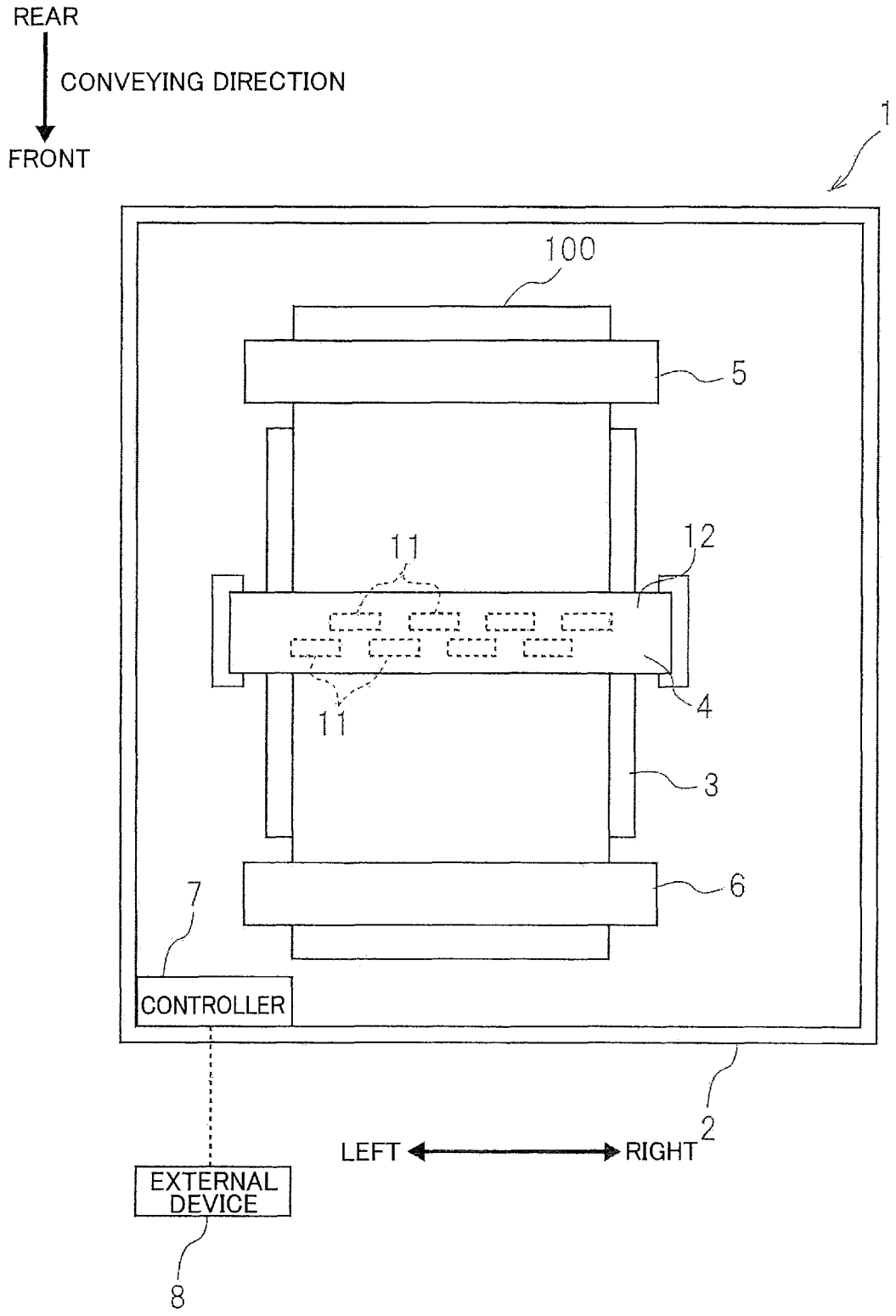
FIG. 1 is a schematic plan view of a printer according to a present embodiment.

As illustrated in FIG. 1, a printer 1 includes a housing 2 that contains a platen 3, an ink-jet head 4, two conveying rollers 5, 6, and a controller 7.

An upper surface of the platen 3 supports a recording sheet 100 as one example of a recording medium conveyed by the two conveying rollers 5, 6. The two conveying rollers 5, 6 are respectively disposed at a rear of and in front of the platen 3. The two conveying rollers 5, 6 are rotated by a motor, not illustrated, to convey the recording sheet 100 frontward on the platen 3.

The ink-jet head 4 is a line head disposed over the platen 3 and extending throughout the entire length of the recording sheet 100 in the right and left direction. The ink-jet head 4 ejects ink onto the recording sheet 100 during image recording without change in position of the ink-jet head 4. Inks of four colors, namely, black, yellow, cyan, and magenta are supplied to the ink-jet head 4 from ink tanks, not illustrated. That is, the ink-jet head 4 is an ink-jet head configured to eject the inks of the four colors.

Figure 2:
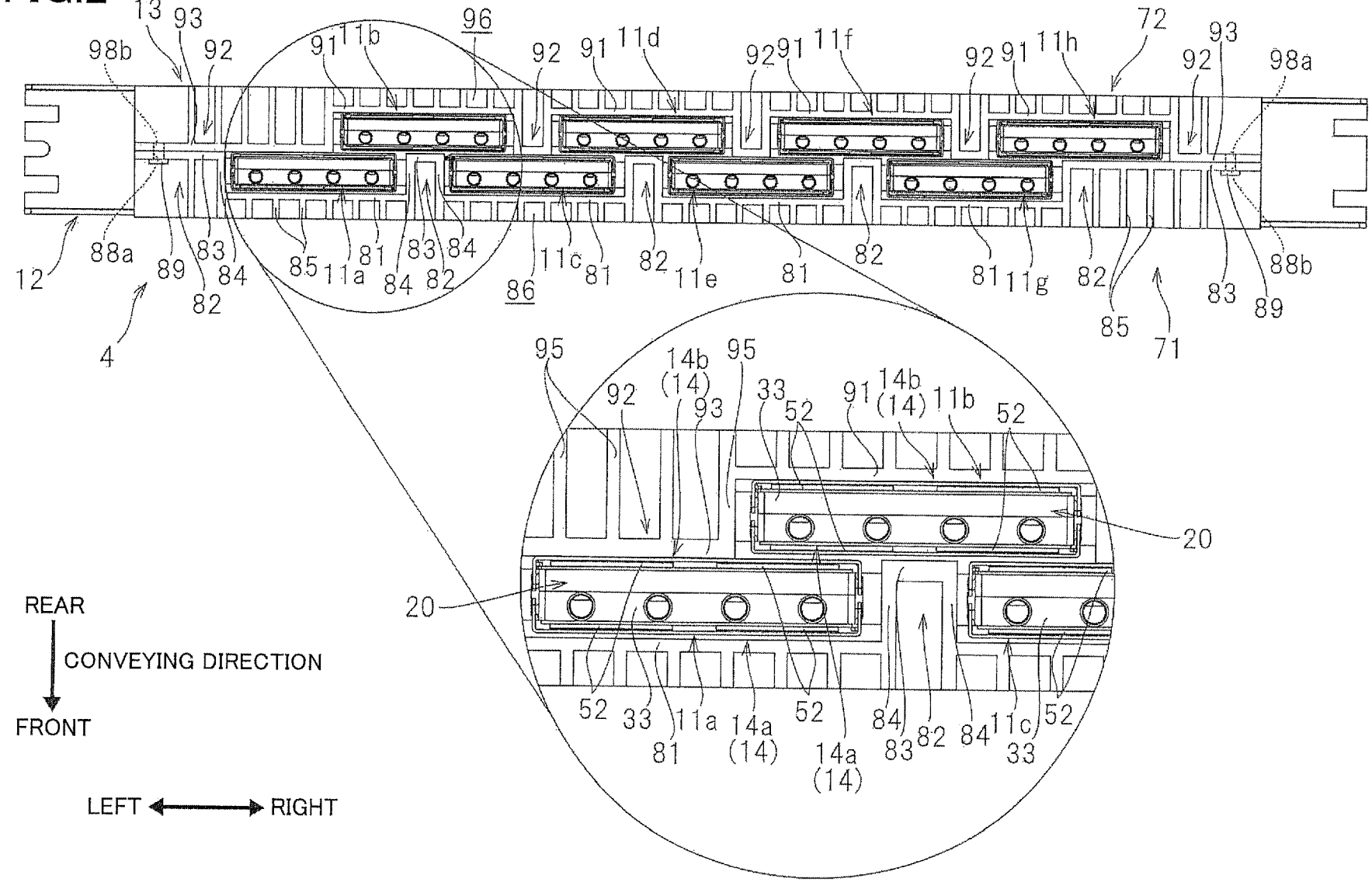
FIG. 2 is a top view of an ink-jet head.

As illustrated in FIG. 2, the ink-jet head 4 includes eight head units 11*a*-11*h*, a supporter 12, a common heat sink 13, and individual heat sinks 14. In the following description, the head units 11*a*-11*h* may be collectively referred to as "head unit 11" in the case where the distinction of the head units 11*a*-11*h* is not required.

The eight head units 11 are arranged in the right and left direction in a staggered configuration and have the same structure. Specifically, the four head units 11*a*, 11*c*, 11*e*, 11*g* are arranged in a row in the right and left direction, and the four head units 11*b*, 11*d*, 11*f*, 11*h* are arranged in a row in the right and left direction. The row of the head units 11*a*, 11*c*, 11*e*, 11*g* is located in front of the row of the head units 11*b*, 11*d*, 11*f*, 11*h* in the conveying direction.

Focusing on two of the head units 11 which are disposed next to each other in the right and left direction (e.g., the head units 11*a*, 11*b*), the two head units 11 disposed next to each other are different in position in the front and rear direction. A right end portion of a unit body 20 (which will be described below) of the left head unit 11 and a left end portion of the unit body 20 of the right head unit 11 are arranged in the front and rear direction. That is, end portions of the respective two head units 11 which are adjacent to each other in the right and left direction are located at the same position in the right and left direction.

Figure 3:
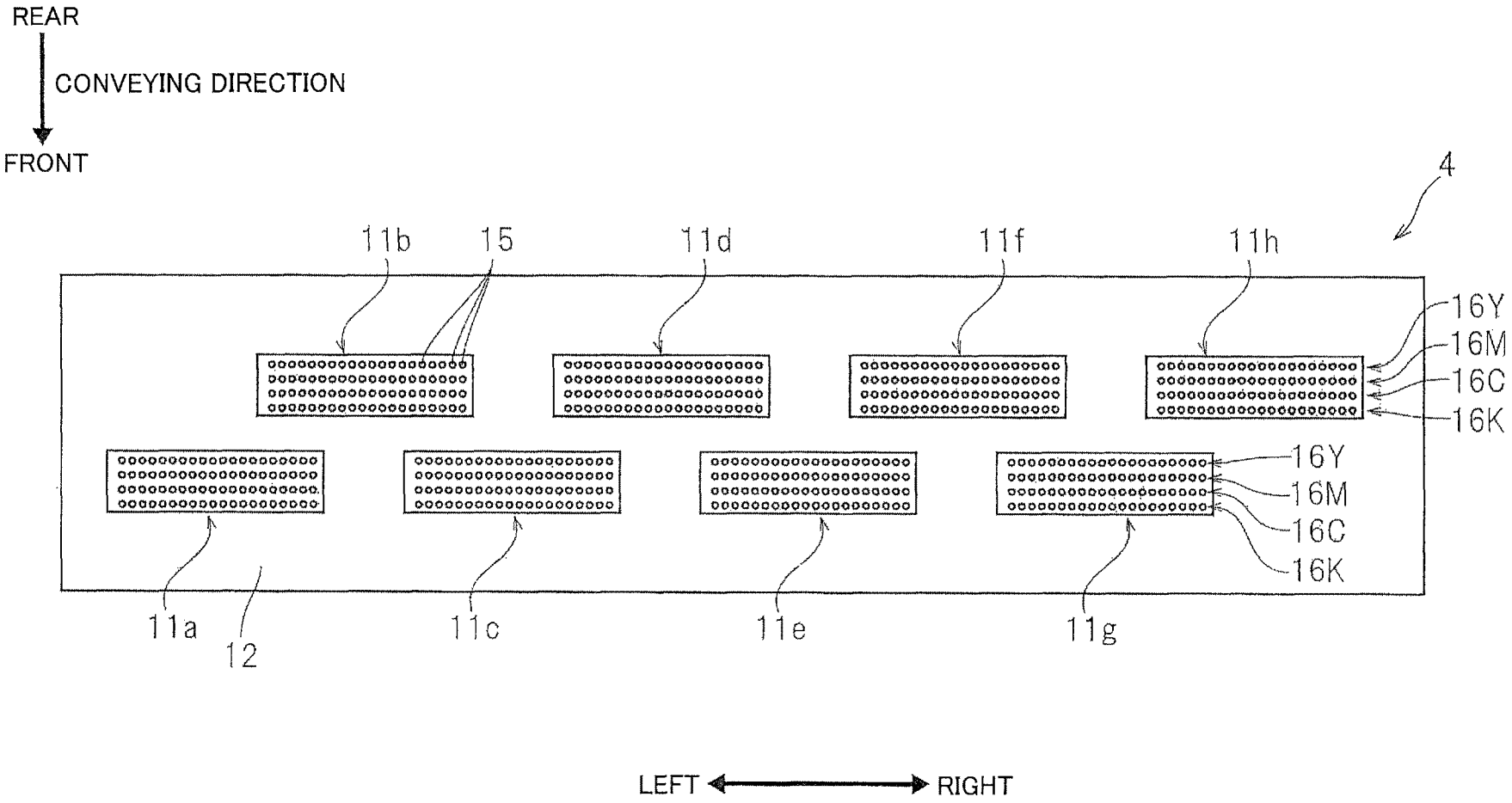
FIG. 3 is a bottom view of the ink-jet head.

As illustrated in FIG. 3, a lower surface of each of the head units 11 has four nozzle rows each constituted by a plurality of nozzles 15 arranged in the right and left direction. The four nozzle rows are arranged in the front and rear direction. This four nozzle rows includes: a nozzle row 16Y for ejection of the yellow ink; a nozzle row 16M for ejection of the magenta ink; a nozzle row 16C for ejection of the cyan ink; and a nozzle row 16K for ejection of the black ink. These four nozzle rows are arranged in the order of the nozzle row 16Y, the nozzle row 16M, the nozzle row 16C, and the nozzle row 16K from an upstream (rear) side in the conveying direction.

The supporter 12 is formed of metal having a relatively high stiffness such as SUS430. The supporter 12 is shaped like a substantially rectangular plate parallel with the horizontal plane and extending in the right and left direction. Opposite ends of the supporter 12 are fixed to the housing 2. The supporter 12 supports the eight head units 11 such that the eight head units 11 have the above-described positional relationship. The supporter 12 also supports the common heat sink 13.

The common heat sink 13 and the individual heat sinks 14 dissipate heat generated by driver ICs 52 (which will be described below) of the eight head units 11, to make temperatures of the driver ICs 52 uniform. The common heat sink 13 is shared among the eight head units 11, and the individual heat sinks 14 are provided individually for the head unit 11.

The controller 7 includes a central processing unit (CPU), a read only memory (ROM), a random access memory (RAM), and an application-specific integrated circuit (ASIC) including various kinds of control circuits. The controller 7 is connected to an external device 8 such as a personal computer (PC) for data communication. The controller 7 controls devices of the printer 1 based on image data transmitted from the external device 8.

More specifically, the controller 7 controls the motor such that the two conveying rollers 5, 6 convey the recording sheet 100 in the conveying direction. During this control, the controller 7 controls the ink-jet head 4 to eject the ink onto the recording sheet 100 to form an image on the recording sheet 100.

Detailed Configuration of Head Unit

There will be next explained a configuration of the head unit 11 in detail. As illustrated in FIGS. 4-9, each of the head units 11 includes the unit body 20 and two chip-on-films COFs 21 (a COF 21*a* and a COF 21*b*).

Figure 4:
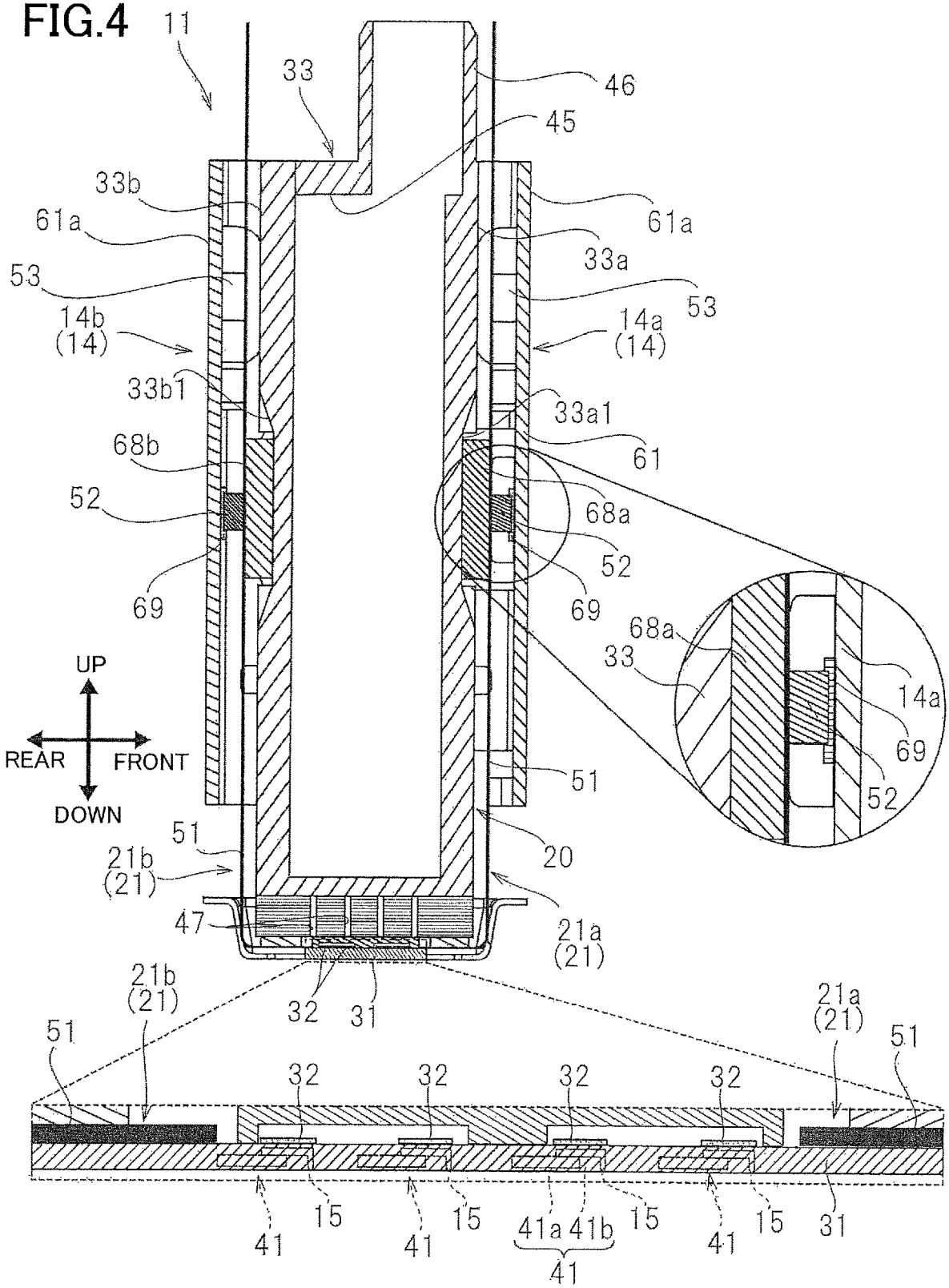
FIG. 4 is a cross-sectional view of a head unit and individual heat sinks.
Figure 5:
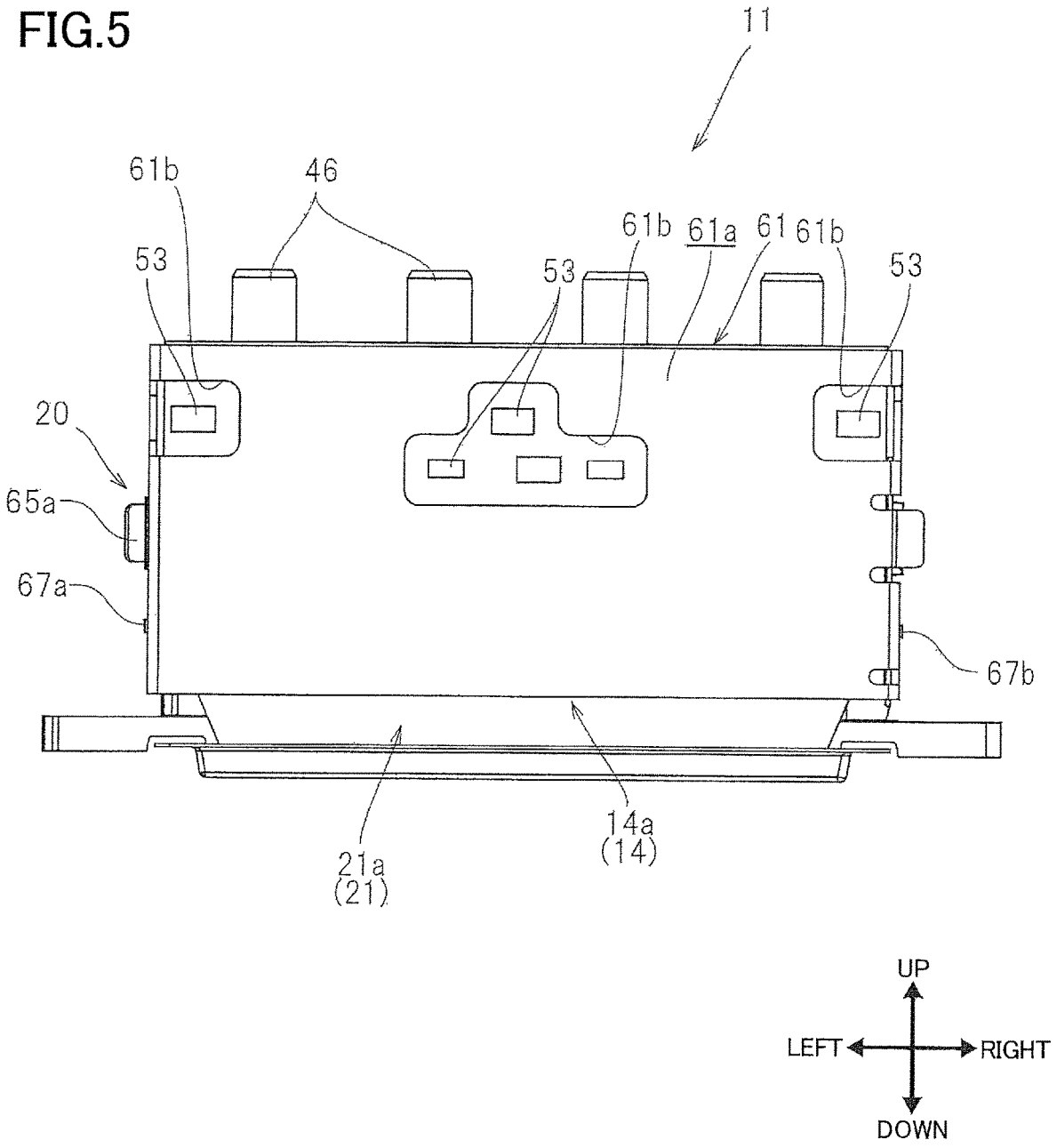
FIG. 5 is a front view of the head unit and the individual heat sink.

First, the unit body 20 will be described. As illustrated in FIG. 4, the unit body 20 includes a passage defining member 31, four actuators 32, and a reservoir defining member 33.

The passage defining member 31 is shaped like a planar plate and formed of silicon. As illustrated in FIG. 4, a lower surface of the passage defining member 31 has the nozzles 15. An upper surface of the passage defining member 31 has four ink supply openings, not illustrated, to which the ink is supplied from the reservoir defining member 33. The passage defining member 31 has four ink passages 41 corresponding to the respective four colors of the inks. Each of the ink passages 41 has: a manifold 41*a* communicating with a corresponding one of the ink supply openings and extending in the right and left direction (a direction perpendicular to the sheet surface of FIG. 4); and a multiplicity of pressure chambers 41*b* communicating with the manifold 41*a*. The pressure chambers 41*b* communicate with the respective nozzles 15. The pressure chambers 41*b* of the ink passage 41 are arranged in the right and left direction so as to form one pressure-chamber row. That is, the passage defining member 31 has four pressure-chamber rows corresponding to the respective four colors of the inks.

The four actuators 32 are arranged in the front and rear direction on the upper surface of the passage defining member 31. The four actuators 32 correspond to the respective four colors of the inks. In other words, the four actuators 32 correspond to the respective four pressure-chamber rows. Each of the actuators 32 includes: an insulating layer formed on the passage defining member 31 so as to cover the pressure chambers 41*b* of a corresponding one of the pressure-chamber rows; and a multiplicity of piezoelectric elements arranged on an upper surface of the insulating layer at positions overlapping the respective pressure chambers 41*b*. Each of the actuators 32 is configured such that when a voltage is applied to the actuator 32 by a corresponding one of the driver ICs 52 which will be described below, the volumes of the respective pressure chambers 41*b* are selectively changed due to deformation of the respective piezoelectric elements due to inverse piezoelectric effect to apply ejection energy to the ink in the respective pressure chambers 41*b* for ink ejection from the respective nozzles 15.

Wires, not illustrated, extend frontward from front two of the actuators 32. The front two actuators 32 are electrically connected to the COF 21*a*, which will be described below, via the wires. Wires, not illustrated, extend rearward from rear two of the actuators 32. The rear two actuators 32 are electrically connected to the COF 21*b*, which will be described below, via the wires.

The reservoir defining member 33 is disposed on an opposite side of the actuators 32 from the passage defining member 31. In other words, the reservoir defining member 33 is disposed over the actuators 32. The reservoir defining member 33 is joined to upper surfaces of the respective actuators 32. The reservoir defining member 33 is a substantially rectangular parallelepiped member formed of metal or synthetic resin, for example.

An upper half portion of the reservoir defining member 33 has four reservoirs 45 (only one of which is illustrated in FIG. 4) arranged in the right and left direction and respectively corresponding to the inks of the four colors. Tube connectors 46 are respectively provided on upper portions of the respective four reservoirs 45. The four reservoirs 45 are respectively connected to the ink tanks by tubes, not illustrated, connected to the respective tube connectors 46.

A lower half portion of the reservoir defining member 33 has four ink supply passages 47 extending downward from the respective four reservoirs 45. The ink supply passages 47 respectively communicate with the ink supply openings formed in the passage defining member 31. With these constructions, the inks are supplied from the ink tanks to the plurality of pressure chambers 41*b* via the reservoirs 45 and the ink supply passages 47.

A front wall 33*a* of the reservoir defining member 33 has a groove 33*a*1 extending in the right and left direction. An elastic member 68*a* is fitted in the groove 33*a*1. A rear wall 33*b* of the reservoir defining member 33 has a groove 33*b*1 extending in the right and left direction. An elastic member 68*b* is fitted in the groove 33*b*1. Each of the elastic members 68*a*, 68*b* is formed of sponge, rubber, or other similar materials and elongated in the right and left direction as a longitudinal direction of each of the elastic members 68*a*, 68*b*. Since the reservoir defining member 33 has the grooves 33*a*1, 33*b*1 in which the respective elastic members 68*a*, 68*b* are fitted as described above, each of the elastic members 68*a*, 68*b* has a greater thickness in a limited space, resulting in increase in elastic force of each of the elastic members 68*a*, 68*b*. It is noted that the grooves 33*a*1, 33*b*1 of the reservoir defining member 33 are not essential. For example, in the case where the thickness of each of the elastic members 68*a*, 68*b* is small, the grooves 33*a*1, 33*b*1 may not be formed in the reservoir defining member 33.

As illustrated in FIGS. 6-9, engaging portions 65*a*, 66*a* protruding leftward are respectively provided on a front end portion and a rear end portion of a left wall 33*c* of the reservoir defining member 33. Engaging portions 65*b*, 66*b* (see FIG. 9) protruding rightward are respectively provided on a front end portion and a rear end portion of a right wall 33*d* of the reservoir defining member 33. These engaging portions 65*a*, 65*b*, 66*a*, 66*b* are located at the same height position in the up and down direction. The engaging portion 65*a* provided on the front end portion of the left wall 33*c* is a protrusion shaped like a right triangle in plan view. The engaging portion 65*a* has: an inclined surface inclined such that its front portion is located to the left of its rear portion; and a back surface extending in the right and left direction so as to connect between the inclined surface and the left wall 33*c*. It is noted that the engaging portion 65*b* is a protrusion, and the engaging portion 65*b* and the engaging portion 65*a* are symmetrical with respect to a plane extending along the front and rear direction. The engaging portion 66*a* is a protrusion, and the engaging portion 66*a* and the engaging portion 65*a* are symmetrical with respect to a plane extending along the right and left direction. The engaging portion 66*b* is a protrusion having a shape formed by rotating the engaging portion 65*a* by 180 degrees about a center of the unit body 20 in the front and rear direction and the right and left direction on the horizontal plane, which is a plane parallel with the right and left direction and the front and rear direction. In other words, the engaging portion 66*b* is a protrusion having a shape formed by rotating the engaging portion 65*a* by 180 degrees about an axis extending through the center of the unit body 20 and perpendicular to the front and rear direction and the right and left direction. In a modification, each of the engaging portions 65*a*, 65*b*, 66*a*, 66*b* may be shaped like a pawl, for example.

A rib 67*a* is formed on the left wall 33*c* of the reservoir defining member 33 at a position located below the engaging portions 65*a*, 66*a* with a space between the rib 67*a* and each of the engaging portions 65*a*, 66*a*. The rib 67*a* protrudes leftward and extends in the front and rear direction. Likewise, a rib 67*b* protruding rightward and extending in the front and rear direction is formed on the right wall 33*d* of the reservoir defining member 33 at a position located below the engaging portions 65*b*, 66*b* with a space between the rib 67*b* and each of the engaging portions 65*b*, 66*b*.

The COFs 21 will be explained next. As illustrated in FIG. 4, each of the two COFs 21 includes: a flexible board 51 as a wiring member; and the two driver ICs 52 and a plurality of circuit elements 53 mounted on the flexible board 51.

An end portion of the flexible board 51 of the COF 21*a* of the two COFs 21 is electrically connected to wires extending frontward from front two of the actuators 32. After being drawn frontward from a position at which the flexible board 51 of the COF 21*a* is connected to the actuators 32, the flexible board 51 is bent upward and extends upward along the front wall 33*a* of the reservoir defining member 33 so as to be connected to the controller 7. The two driver ICs 52 and the circuit elements 53 are provided on a front surface of a portion of the flexible board 51 which extends upward along the front wall 33*a*. That is, the two driver ICs 52 and the circuit elements 53 of the COF 21*a* are arranged in front of the unit body 20. It is noted that front ends of the respective circuit elements 53 are located further toward the front than the front surface of the portion of the flexible board 51 and the front ends of the respective driver ICs 52.

An end portion of the flexible board 51 of the COF 21*b* of the two COFs 21 is electrically connected to wires extending rearward from rear two of the actuators 32. After being drawn rearward from a position at which the flexible board 51 of the COF 21*b* is connected to the actuators 32, the flexible board 51 is bent upward and extending upward along the rear wall 33*b* of the reservoir defining member 33 so as to be connected to the controller 7. The two driver ICs 52 and the circuit elements 53 are provided on a rear surface of a portion of the flexible board 51 which extends upward along the rear wall 33*b*. That is, the two driver ICs 52 and the circuit elements 53 of the COF 21*b* are arranged at a rear of the unit body 20. It is noted that rear ends of the respective circuit elements 53 are located further toward the rear than the rear surface of the portion of the flexible board 51 and rear ends of the respective driver ICs 52.

Each of the two driver ICs 52 of the COFs 21 has a rectangular parallelepiped shape extending in the right and left direction as its longitudinal direction. The two driver ICs 52 are arranged next to each other in the right and left direction. These driver ICs 52 create and output signals for driving the actuators 32, based on signals transmitted from the controller 7. Each of the circuit elements 53 is a circuit element such as a capacitor and a resistor for noise reduction.

The one head unit 11 as described above includes the four driver ICs 52, each two of which are provided on a corresponding one of the COFs 21. Each of the driver ICs 52 corresponds to corresponding two of the four nozzle rows 16Y, 16M, 16C, 16K and drives the actuators 32 for ejection of the ink from the nozzles 15 of the corresponding two nozzle rows. That is, each of the four driver ICs 52 is associated with corresponding two colors of the inks.

In the present embodiment, each of the two driver ICs 52 of the COF 21*a* which are arranged in front of the head unit 11 corresponds to the front two nozzle rows 16Y, 16M. Each of the two driver ICs 52 of the COF 21*b* which are arranged at a rear of the head unit 11 corresponds to the rear two nozzle rows 16C, 16K.

For each of the head units 11*a*, 11*c*, 11*e*, 11*g*, as illustrated in FIG. 2, a portion of at least one of the two driver ICs 52 disposed at a rear of the unit body 20 is interposed in the front and rear direction between the unit bodies 20 of the respective two head units 11 arranged next to each other in the right and left direction. For example, a portion of a right one of the two driver ICs 52 disposed at a rear of the unit body 20 of the head unit 11*a* is interposed between the unit body 20 of the head unit 11*a* and the unit body 20 of the head unit 11*b* in the front and rear direction. Likewise, for each of the head units 11*b*, 11*d*, 11*f*, 11*h*, a portion of at least one of the two driver ICs 52 disposed in front of the unit body 20 is interposed in the front and rear direction between the unit bodies 20 of the respective two head units 11 arranged next to each other in the right and left direction.

Incidentally, if heat generated by the driver ICs 52 has transferred to the actuators 32 and the passage defining member 31, the ink ejecting operation of the head unit 11 may suffer from various adverse effects such as operational failures of the actuators 32 and changes in ejection characteristics due to change in viscosity of the ink. Also, a driving manner is different among the head units 11 in the ink-jet head 4. Thus, an amount of heat generated by the driver ICs 52 is also different among the head units 11. In the case where the temperature of the driver ICs 52 is different among the head units 11, a manner of ink ejection also becomes different among the head units 11. This difference causes unevenness in density in an image recorded on the recording sheet 100, which may result in deterioration of recording quality. For example, in the case where the temperature of the driver ICs 52 is different between the two head units 11 disposed next to each other, unevenness in density is conspicuous on the recording sheet 100 at a region at which image areas formed by the respective two head units 11 are joined to each other.

To solve this problem, in the present embodiment, the common heat sink 13 and the individual heat sinks 14 dissipate heat generated by the driver ICs 52 to reduce the difference in temperature of the driver ICs 52 among the eight head units 11. The common heat sink 13 and the individual heat sinks 14 will be explained in detail.

Detailed Construction of Individual Heat Sink

As illustrated in FIG. 2, each of the individual heat sinks 14 is formed of metal or a ceramic material having a high thermal conductivity, for example. Each of the head units 11 is provided with corresponding two of the individual heat sinks 14. The following explanation is provided for the two individual heat sinks 14*a*, 14*b* provided on one head unit 11, assuming that a flat plate 61 (which will be described below) of each of the individual heat sinks 14 is disposed parallel with the vertical plane.

The individual heat sink 14*a* is disposed in front of the head unit 11. The individual heat sink 14*b* is disposed at a rear of the head unit 11.

As illustrated in FIGS. 5-9, the individual heat sink 14*a* includes: the flat plate 61 having a rectangular shape extending in the right and left direction along the front wall 33*a* of the reservoir defining member 33; and side plates 62, 63 extending rearward respectively from opposite end portions of the flat plate 61 in the right and left direction. The flat plate 61 is disposed so as to cover the two driver ICs 52 of the COF 21*a*. A rear surface of the flat plate 61 is in thermal contact with the two driver ICs 52 of the COF 21*a*. A front surface of the flat plate 61 is a facing surface 61*a* facing and being in direct contact with the common heat sink 13. Since the individual heat sink 14*a* has the flat facing surface 61*a*, heat is effectively transferred between the individual heat sink 14*a* and the common heat sink 13. Incidentally, the front ends of the circuit elements 53 mounted on the COF 21*a* are located in front of the front surface of the flexible board 51 as described above. This positional relationship may lead to damage of the circuit elements 53 due to their contact with the flat plate 61. To avoid this damage, in the present embodiment, three through holes 61*b* are formed through the flat plate 61 in the front and rear direction. Each of the circuit elements 53 mounted on the COF 21*a* is disposed in a corresponding one of the three through holes 61*b*. This construction reduces a possibility of the breakage of the circuit elements 53 due to their contact with the individual heat sink 14.

The width of the flat plate 61 in the right and left direction is slightly greater than that of the front wall 33*a* in the right and left direction. The reservoir defining member 33 is interposed between the side plates 62, 63 of the individual heat sink 14*a* in the right and left direction.

Figure 6:
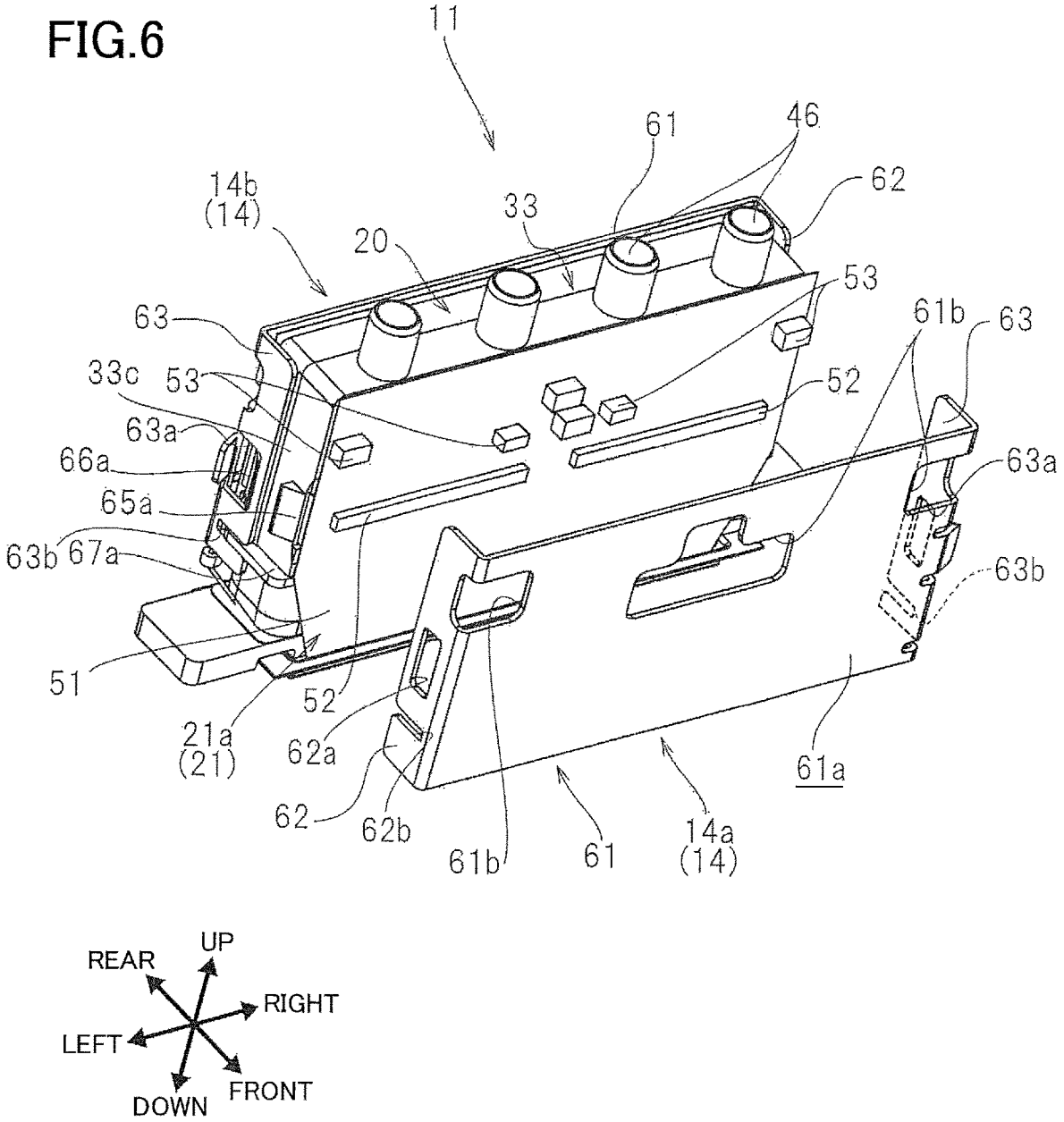
FIG. 6 is an exploded perspective view of the head unit and the individual heat sinks.
Figure 7:
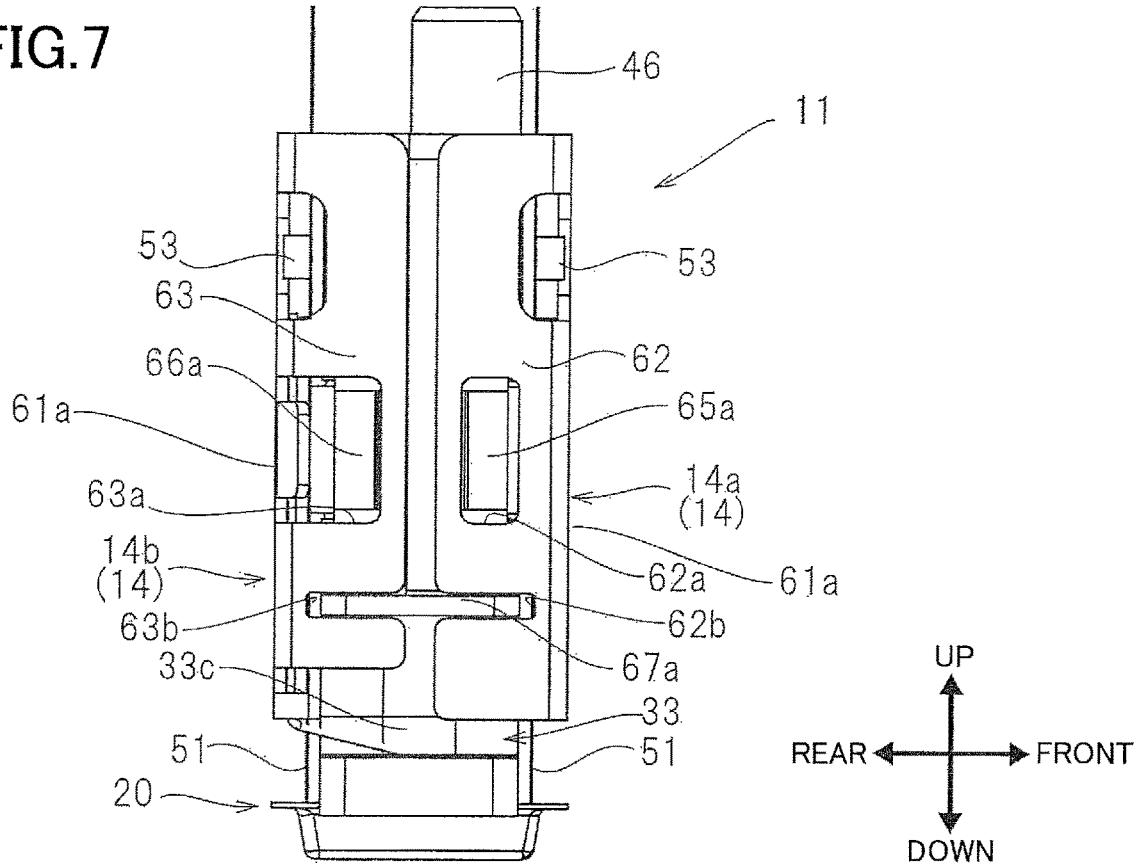
FIG. 7 is a left side view of the head unit and the individual heat sinks.
Figure 8:
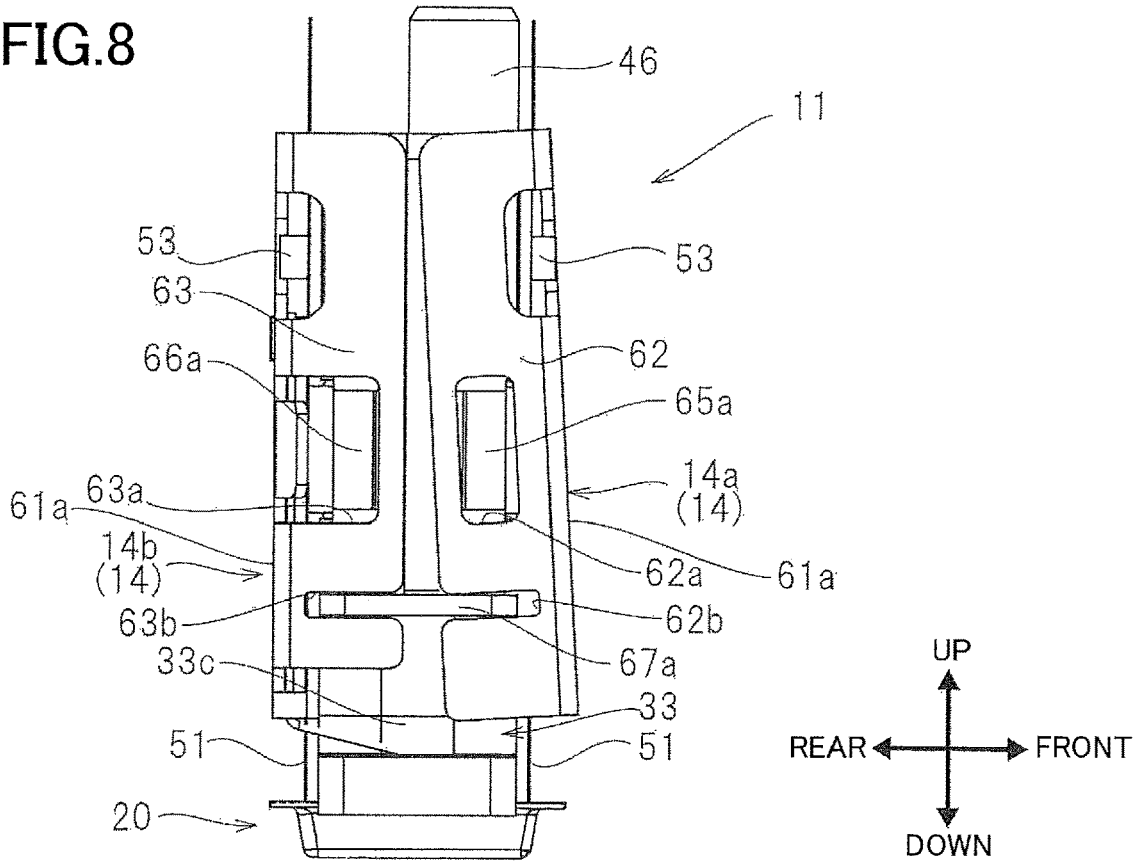
FIG. 8 is a left side view of the head unit and the individual heat sinks.
Figure 9:
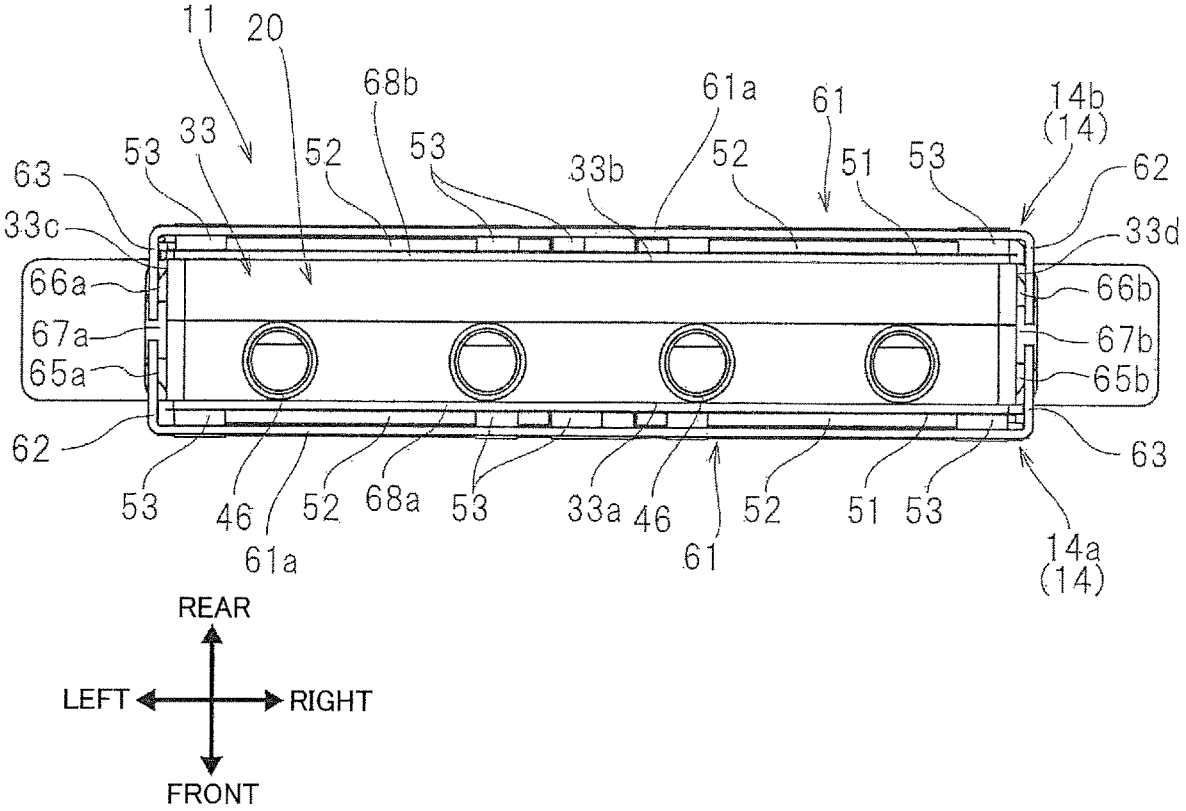
FIG. 9 is a top view of the head unit and the individual heat sinks.

As illustrated in FIGS. 6-8, an insertion hole 62*a* is formed through the left side plate 62 of the individual heat sink 14*a* in the right and left direction at a central region of the left side plate 62 in the up and down direction. An insertion hole 63*a* (illustrated only in FIG. 6) is formed through the right side plate 63 of the individual heat sink 14*a* in the right and left direction at a central region of the right side plate 63 in the up and down direction. Each of the insertion holes 62*a*, 63*a* is elongated in the up and down direction. The engaging portions 65*a*, 65*b* in the form of the protrusions formed on the reservoir defining member 33 are inserted in the respective insertion holes 62*a*, 63*a* and engaged with the flat plate 61. As a result, the individual heat sink 14*a* is supported by the reservoir defining member 33. Thus, the individual heat sink 14*a* is supported by the reservoir defining member 33 with a simple structure in which the engaging portions 65*a*, 65*b* are inserted in the respective insertion holes 62*a*, 63*a* and engaged with the flat plate 61. In addition, supporting the individual heat sink 14*a* by the reservoir defining member 33 simplifies a structure when compared with a structure in which the individual heat sink 14*a* is supported by other components of the ink-jet head 4.

As illustrated in FIGS. 7 and 8, each of the insertion holes 62*a*, 63*a* is larger in size than a corresponding one of the engaging portions 65*a*, 65*b* in the form of the protrusions, so that the engaging portions 65*a*, 65*b* are loosely inserted in the respective insertion holes 62*a*, 63*a*. That is, a space is formed between each of the engaging portions 65*a*, 65*b* and a corresponding one of hole defining surfaces of the respective insertion holes 62*a*, 63*a*. The individual heat sink 14*a* is supported by the reservoir defining member 33 only by the insertion of the engaging portions 65*a*, 65*b* in the form of the protrusions in the respective insertion holes 62*a*, 63*a*. Thus, the individual heat sink 14*a* is movably and loosely secured to the reservoir defining member 33. Accordingly, this space enables the individual heat sink 14*a* to move in the front and rear direction by an amount of the space in the front and rear direction in the state in which the individual heat sink 14*a* is supported by the reservoir defining member 33. Furthermore, as illustrated in FIG. 8, the individual heat sink 14*a* is pivotable about a straight line connecting between the engaging portion 65*a* and the engaging portion 65*b*.

Here, the elastic member 68*a* is positioned by the groove 33*a*1 in a state in which the elastic member 68*a* is interposed between the front wall 33*a* of the reservoir defining member 33 and the two driver ICs 52 of the COF 21*a*. When viewed in the front and rear direction, the two driver ICs 52 of the COF 21*a* are located within an area on which the elastic member 68*a* is formed.

The two driver ICs 52 of the COF 21*a* are urged frontward by the elastic member 68*a* to the individual heat sink 14*a*. As a result, the two driver ICs 52 of the COF 21*a* are in thermal contact with the individual heat sink 14*a*. It is noted that the elastic member 68*a* also urges the individual heat sink 14*a* frontward via the two driver ICs 52 of the COF 21*a*. Thus, as illustrated in FIG. 7, in a state in which no load acts on the individual heat sink 14*a* from the common heat sink 13, the individual heat sink 14*a* is located at the furthest position from the reservoir defining member 33 in the front and rear direction. When the individual heat sink 14*a* is located at the furthest position, hole defining surfaces of rear portions of the respective insertion holes 62*a*, 63*a* are respectively in contact with back surfaces of the respective engaging portions 65*a*, 65*b*.

Figure 10:
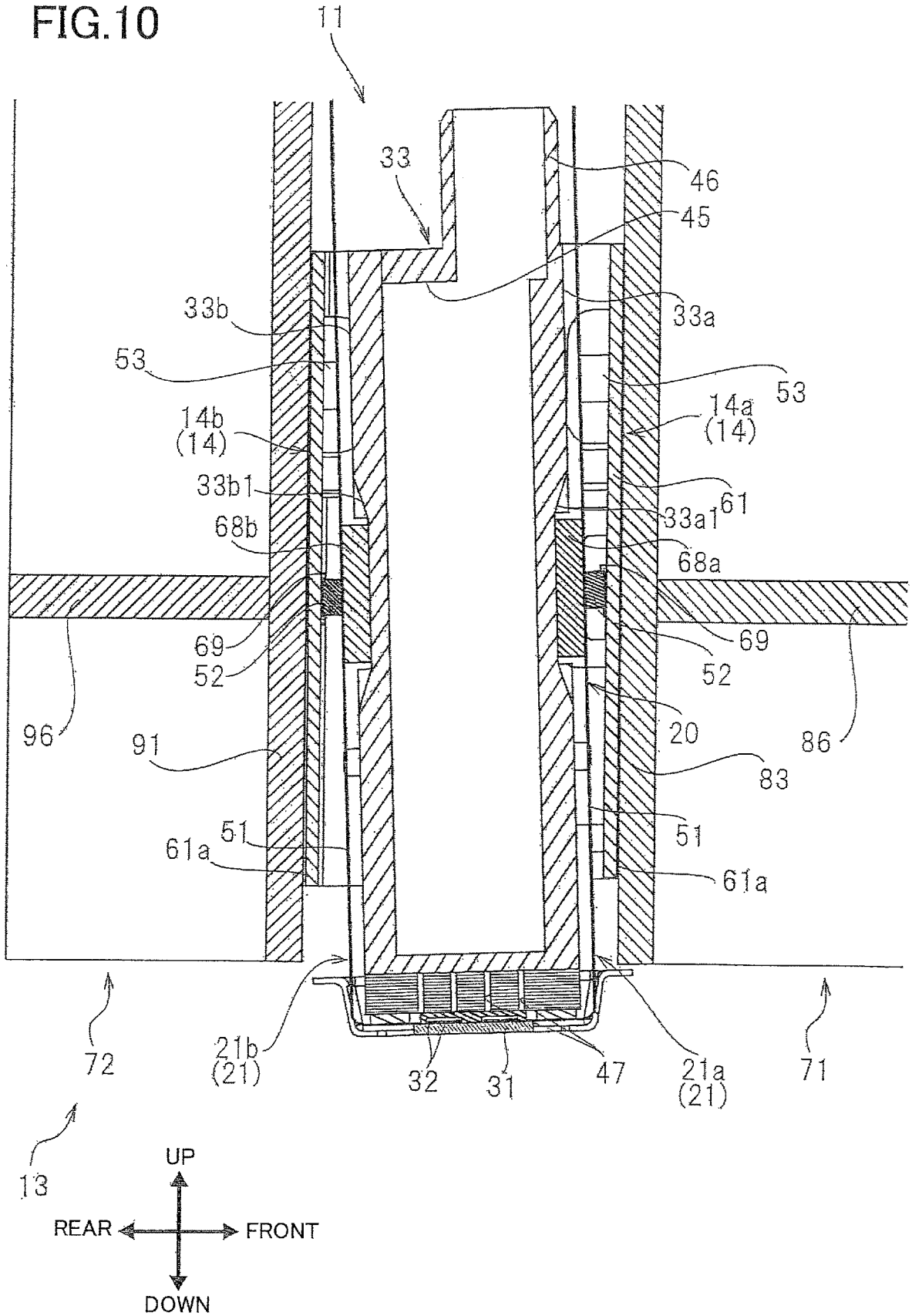
FIG. 10 is a cross-sectional view of the head unit, a common heat sink, and the individual heat sinks.

Also, in the present embodiment, the two driver ICs 52 of the COF 21*a* are arranged on the straight line connecting between the engaging portion 65*a* and the engaging portion 65*b*. That is, the individual heat sink 14*a* is pivotable about the two driver ICs 52 of the COF 21*a* as a pivot axis, and this pivot axis extends along the longitudinal direction of the driver ICs 52. In other words, the reservoir defining member 33 supports the individual heat sink 14*a* at a support position located on the pivot axis extending along the longitudinal direction of the driver ICs 52, such that the individual heat sink 14*a* is pivotable. Accordingly, as illustrated in FIG. 10, even in the case where the individual heat sink 14*a* is pivoted about the above-described pivot axis, the individual heat sink 14*a* and the two driver ICs 52 of the COF 21*a* are kept in thermal contact with each other. It is noted that the support position at which the individual heat sink 14*a* is supported by the reservoir defining member 33 need not be a position on the above-described pivot axis, but setting the support position on the pivot axis simplifies a structure for supporting the individual heat sink 14*a* pivotably. The elastic member 68*a* for urging the driver ICs 52 also extends along the driver ICs 52 in a state in which the longitudinal direction of the elastic member 68*a* coincides with the axial direction of the pivot axis. That is, the elastic member 68*a* is also disposed on or near the pivot axis of the individual heat sink 14*a*. This construction enables the individual heat sink 14*a* to pivot without contact with the elastic member 68*a*.

As illustrated in FIG. 4, an elastic member 69 is provided at and near an area between the individual heat sink 14*a* and the two driver ICs 52 of the COF 21*a*. This elastic member 69 reduces a possibility of damage to the driver ICs 52 even in the case where stress applied from the individual heat sink 14*a* concentrates on a portion of the driver ICs 52 (e.g., a corner portion). This elastic member 69 may be easily formed by, for example, applying a potting material or grease to the individual heat sink 14*a* or the driver ICs 52. Alternatively, the elastic member 69 may be formed of a thermally-conductive potting material, which enables efficient thermal transfer from the driver ICs 52 to the individual heat sink 14*a*. It is noted that the elastic member 69 may be provided at or around the area between the individual heat sink 14*a* and the driver ICs 52.

In the present embodiment, incidentally, a space is also formed between each of the hole defining surfaces of the respective insertion holes 62*a*, 63*a* and a corresponding one of the engaging portions 65*a*, 65*b* in the up and down direction in order to make the individual heat sink 14*a* movable in the front and rear direction and pivotable about the pivot axis coinciding with the straight line connecting between the engaging portion 65*a* and the engaging portion 65*b*. This construction may however lead to insufficient contact between the individual heat sink 14*a* and the two driver ICs 52 of the COF 21*a* due to long movement of the individual heat sink 14*a* in the up and down direction.

To solve this problem, in the present embodiment, as illustrated in FIG. 6, cutout portions 62*b*, 63*b* are respectively formed in portions of the respective side plates 62, 63 which are located below the respective insertion holes 62*a*, 63*a*. The cutout portions 62*b*, 63*b* are formed by cutting out the respective side plates 62, 63 frontward from their respective outer edges. Front end portions of the respective ribs 67*a*, 67*b* formed respectively on the left wall 33*c* and the right wall 33*d* of the reservoir defining member 33 are inserted in the respective cutout portions 62*b*, 63*b*. The length of each of the cutout portions 62*b*, 63*b* in the up and down direction is greater than that of each of the ribs 67*a*, 67*b* in the up and down direction. Thus, a space is formed between an inner wall surface of each of the cutout portions 62*b*, 63*b* and a corresponding one of the ribs 67*a*, 67*b* in the up and down direction.

The space formed between the inner wall surface of each of the cutout portions 62*b*, 63*b* and the corresponding one of the ribs 67*a*, 67*b* in the up and down direction is smaller than the space formed between the hole defining surface of each of the insertion holes 62*a*, 63*a* and the corresponding one of the engaging portions 65*a*, 65*b* in the up and down direction. This construction enables the individual heat sink 14*a* to move in the up and down direction by a distance corresponding to the space formed between the inner wall surface of each of the cutout portions 62*b*, 63*b* and the corresponding one of the ribs 67*a*, 67*b* in the up and down direction. The movement of the individual heat sink 14*a* in the up and down direction is limited by the ribs 67*a*, 67*b*. This construction prevents long movement of the individual heat sink 14*a* in the up and down direction, making it possible to keep the state in which the individual heat sink 14*a* and the two driver ICs 52 of the COF 21*a* are in contact with each other. In a modification, the ink-jet head 4 may be configured such that the cutout portions 62*b*, 63*b* are respectively formed in portions of the respective side plates 62, 63 which are located higher than the respective insertion holes 62*a*, 63*a*, and each of the ribs 67*a*, 67*b* is spaced upwardly from a corresponding one of the engaging portions 65*b*, 66*b*. Also in this modification, it is possible to prevent long movement of the individual heat sink 14*a* in the up and down direction.

It is noted that when the individual heat sink 14*a* is located at the furthest position (see FIG. 7), a space is formed between, in the front and rear direction, a front end of each of the ribs 67*a*, 67*b* and an inner wall of a corresponding one of the cutout portions 62*b*, 63*b* which is a bottom of the cutout and which extends in the up and down direction. This space is larger than or equal to the space formed between the hole defining surface of each of the insertion holes 62*a*, 63*a* and the corresponding one of the engaging portions 65*a*, 65*b* in the front and rear direction. Accordingly, the individual heat sink 14*a* is movable by a distance corresponding to the space between the hole defining surface of each of the insertion holes 62*a*, 63*a* and the corresponding one of the engaging portions 65*a*, 65*b* in the front and rear direction, without movement of the individual heat sink 14*a* being limited by the ribs 67*a*, 67*b* in the front and rear direction.

There will be next explained the individual heat sinks 14*b*. Each of the individual heat sinks 14*b* has a shape formed by rotating the individual heat sink 14*a* by 180 degrees on the horizontal plane about the center of the unit body 20 in the front and rear direction and the right and left direction. In other words, each of the individual heat sinks 14*b* has a shape formed by rotating the individual heat sink 14*a* by 180 degrees about an axis extending through the center of the unit body 20 and perpendicular to the front and rear direction and the right and left direction. This construction enables the individual heat sink 14*a* and the individual heat sink 14*b* to be manufactured in the same process by the same manufacturing device, resulting in reduced manufacturing cost of the individual heat sink 14*a* and the individual heat sink 14*b*. For example, in the case where the individual heat sink 14*a* and the individual heat sink 14*b* are manufactured by extrusion molding, a common mold may be used without need for using individual molds for the individual heat sink 14*a* and the individual heat sink 14*b*, resulting in manufacturing cost. It is noted that the same reference numerals as used for the elements of the individual heat sink 14*a* are used to designate the corresponding elements of the individual heat sink 14*b*, and an explanation of which is dispensed with.

Each of the individual heat sinks 14*b* is supported by the reservoir defining member 33 by inserting the engaging portions 66*a*, 66*b* formed in the reservoir defining member 33, respectively in insertion holes 62*a*, 63*a* formed in respective side plates 62, 63 of the individual heat sink 14*b*. The two driver ICs 52 of the COF 21*b* are urged to the individual heat sink 14*b* by an elastic member 68*b*. It is noted that the elastic member 68*b* also urges the individual heat sink 14*b* rearward via the two driver ICs 52 of the COF 21*b*. A structure of the reservoir defining member 33 for supporting the individual heat sink 14*b* is the same as the structure of the reservoir defining member 33 for supporting the individual heat sink 14*a*, and an explanation of which is dispensed with.

Detailed Construction of Common Heat Sink

The common heat sink 13 is formed of metal or a ceramic material having a high thermal conductivity, such as ADC12 aluminum alloy. As illustrated in FIG. 2, the common heat sink 13 includes: a first heat uniforming member 71 disposed on a front side with respect to the eight head units 11; and a second heat uniforming member 72 disposed on a rear side with respect to the eight head units 11. The first heat uniforming member 71 and the second heat uniforming member 72 are formed independently of each other.

The first heat uniforming member 71 extends in the right and left direction and includes four base walls 81 and five protrusions 82 each protruding to a position located further toward the rear than the base walls 81. The base walls 81 and the protrusions 82 are arranged alternately in the right and left direction.

Each of the four base walls 81 is shaped like a planar plate parallel with the vertical plane and extending in the right and left direction. The width of each of the base walls 81 in the right and left direction is greater than that of the head unit 11 in the right and left direction. The four base walls 81 respectively correspond to the front head units 11*a*, 11*c*, 11*e*, 11*g*. Each of the base walls 81 is disposed in front of a corresponding one of the head units 11. A rear surface of each of the base walls 81 faces the entire facing surface 61*a* of the flat plate 61 of the individual heat sink 14*a* provided on the corresponding head unit 11, such that the rear surface is in direct contact with the entire facing surface 61*a*. Accordingly, the individual heat sink 14*a* provided on each of the head units 11*a*, 11*c*, 11*e*, 11*g* is located between a corresponding one of the base walls 81 and the driver ICs 52 of the COF 21*a* of the head unit 11, such that the individual heat sink 14*a* is in thermal contact with the driver ICs 52 and the base wall 81.

The five protrusions 82 are disposed such that the protrusions 82 and the head units 11*a*, 11*c*, 11*e*, 11*g* are arranged in the right and left direction. Specifically, the five protrusions 82 are arranged such that adjacent two of the protrusions 82 in the right and left direction interpose a corresponding one of the head units 11*a*, 11*c*, 11*e*, 11*g*. That is, the protrusions 82 and the head units 11 are arranged alternately in the right and left direction.

Each of the five protrusions 82 includes a head-unit-opposed wall 83 and at least one connection wall 84.

The head-unit-opposed wall 83 is disposed further toward the rear than the base walls 81 and shaped like a planar plate parallel with the vertical plane and extending in the right and left direction. The connection wall 84 is shaped like a planar plate extending in the front and rear direction so as to connect the head-unit-opposed wall 83 and the base wall 81 adjacent to the head-unit-opposed wall 83. Accordingly, a continuous wall is formed at a rear edge of the first heat uniforming member 71 by the four base walls 81 and the walls 83 and the connection walls 84 of the five protrusions 82. It is noted that each of the walls 83 and the connection walls 84 of the protrusions 82 has a larger thickness than each of the base walls 81 for increase in thermally conductive area.

Figure 11:
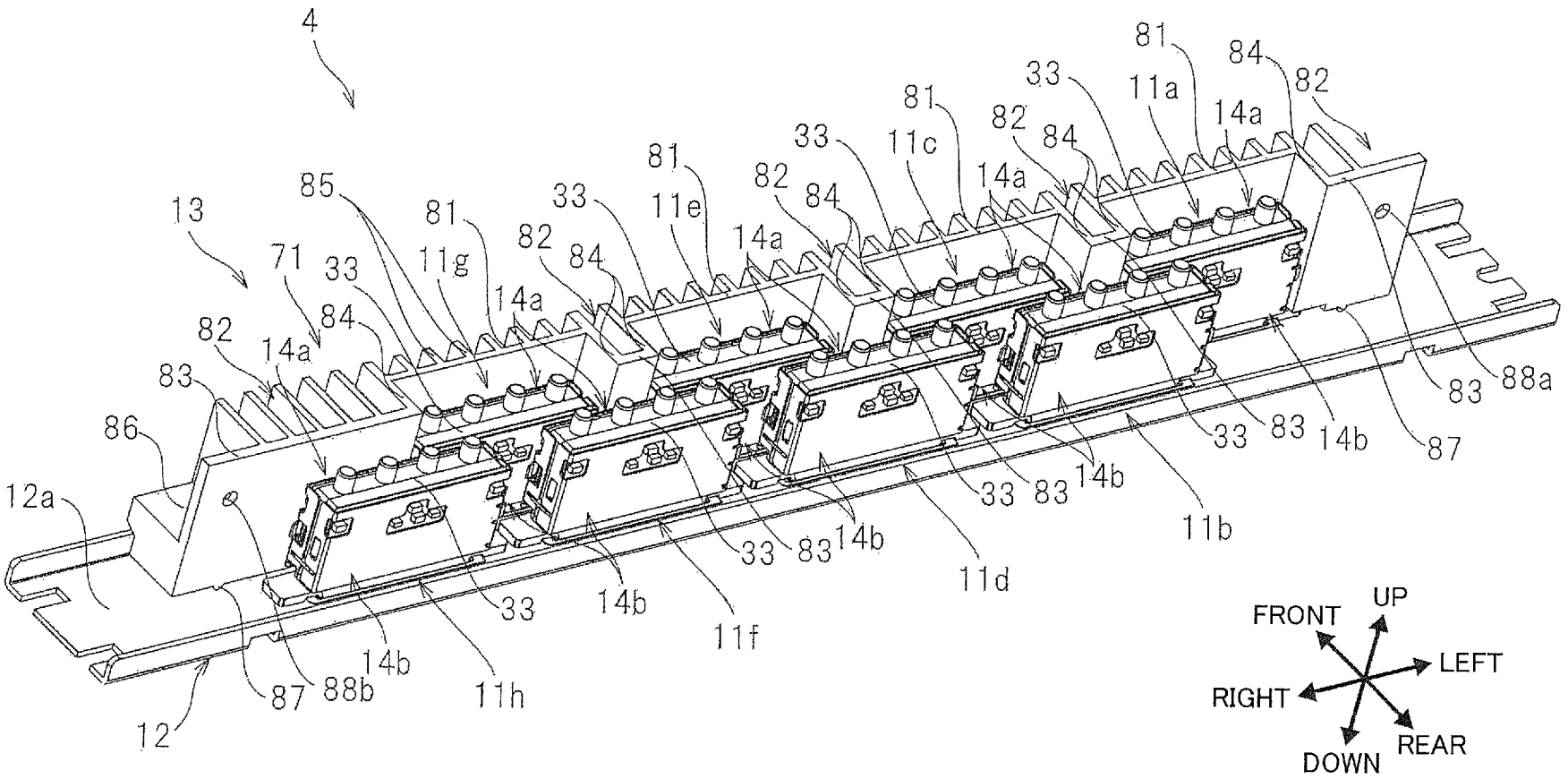
FIG. 11 is a perspective view of the ink-jet head, with a second heat uniforming member removed.
Figure 12:
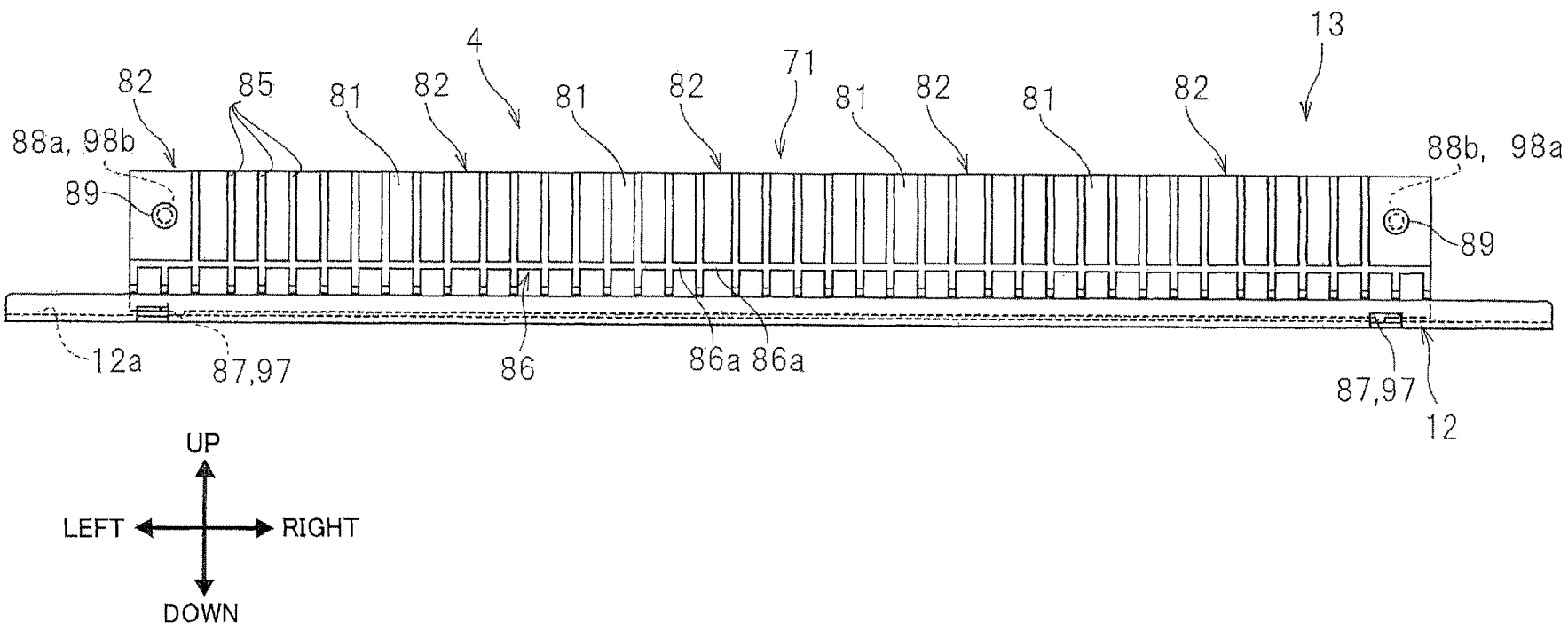
FIG. 12 is a side view of the ink-jet head.

In each of opposite outermost two of the protrusions 82 of the first heat uniforming member 71 in the right and left direction, as illustrated in FIGS. 11 and 12, the head-unit-opposed wall 83 has a width longer than that of the head-unit-opposed wall 83 of each of the other three protrusions 82 in the right and left direction. The walls 83 of the opposite outermost two protrusions 82 in the right and left direction respectively have through holes 88*a*, 88*b* formed through the respective walls 83 in the front and rear direction. The through hole 88*a* of the leftmost protrusion 82 is located to the left of the eight head units 11, and the through hole 88*b* of the rightmost protrusion 82 is formed to the right of the eight head units 11. A screw 89 is inserted in the through hole 88*a* and a through hole 98*b* (which will be described below) of the second heat uniforming member 72, and another screw 89 is inserted in the through hole 88*b* and a through hole 98*a* (which will be described below) of the second heat uniforming member 72, whereby the first heat uniforming member 71 and the second heat uniforming member 72 are secured to each other while themaly contacting with each other.

As illustrated in FIG. 2, right four of the five protrusions 82 respectively correspond to the rear four head units 11*b*, 11*d*, 11*f*, 11*h* of the eight head units 11. The head-unit-opposed wall 83 of each of the right four protrusions 82 is disposed in front of a corresponding one of the head units 11. A rear surface of the head-unit-opposed wall 83 of each of the right four protrusions 82 faces a portion of the facing surface 61*a* of the flat plate 61 of the individual heat sink 14*a* provided on the corresponding head unit 11, whereby the rear surface of the head-unit-opposed wall 83 is in direct contact with the portion of the facing surface 61*a*. The individual heat sink 14*a* provided on each of the head units 11*b*, 11*d*, 11*f*, 11*h* is disposed between a corresponding one of the walls 83 and the driver ICs 52 of the COF 21*a* of the head unit 11, such that the individual heat sink 14*a* is in thermal contact with the driver ICs 52 and the head-unit-opposed wall 83.

As described above, each of the right four protrusions 82 of the first heat uniforming member 71 protrudes rearward toward the corresponding head unit 11 and is in thermal contact with the individual heat sink 14*a* provided on the corresponding head unit 11. The first heat uniforming member 71 is in direct and thermal contact with the individual heat sinks 14*a* provided on the respective eight head units 11. This construction enables transfer of heat generated by each of the driver ICs 52 of the COFs 21*a* of the head units 11 among the driver ICs 52 via the first heat uniforming member 71 and the individual heat sinks 14*a* provided on the respective head units 11. This heat transfer results in reduced difference in temperature among the driver ICs 52 of the COFs 21*a* of the eight head units 11.

In the present embodiment, at least a portion of one of the driver ICs 52 is interposed in the front and rear direction between the head units 11 disposed next to each other. If the ink-jet head 4 does not include the individual heat sinks 14, and only the common heat sink 13 dissipates heat generated by the driver ICs 52, it is difficult to bring the entire driver IC 52 interposed between the head units 11 disposed next to each other, into contact with the common heat sink 13. Thus, heat generated by the driver ICs 52 cannot be efficiently transferred to the common heat sink 13. In the present embodiment, however, each of the individual heat sinks 14*a* is provided on the corresponding head unit 11 so as to cover the entire driver ICs 52. Accordingly, heat generated by the driver IC 52 interposed between the head units 11 disposed next to each other is efficiently transferred to the common heat sink 13 via the individual heat sink 14*a*. In the present embodiment as described above, it is possible to efficiently transfer heat generated by the driver IC 52 to the common heat sink 13 via the individual heat sink 14 in either of the case where the head-unit-opposed wall 83 of the protrusion 82 only partly overlaps the driver IC 52 of the corresponding head unit 11 when viewed in the front and rear direction and the case where the head-unit-opposed wall 83 does not overlap the driver IC 52 when viewed in the front and rear direction.

In the present embodiment, the area of contact between the head-unit-opposed wall 83 of the protrusion 82 and the individual heat sink 14*a* is smaller than the area of contact between the base wall 81 and the individual heat sink 14*a*. As illustrated in FIG. 2, however, each of the head-unit-opposed wall 83 and the connection wall 84 of the protrusion 82 has a greater thickness than the base wall 81 so as to increase the thermally conductive area of the protrusion 82. This construction enables efficient heat transfer between the protrusion 82 and the driver ICs 52 of the corresponding head unit 11.

Heat dissipating fins 85 are formed on the walls 83 of the opposite outermost two protrusions 82 in the right and left direction and the four base walls 81. Specifically, the heat dissipating fins 85 are formed on front surfaces of the respective four base walls 81 and front surfaces of the respective walls 83 (each of which front surfaces is one of opposite surfaces which is further from the head unit 11 than the other in the front and rear direction). Each of the heat dissipating fins 85 protrudes frontward and extends in the up and down direction. Positions of front ends of the heat dissipating fins 85 are the same as each other. The heat dissipating fins 85 enables continuous air cooling of the first heat uniforming member 71.

As illustrated in FIG. 12, plates 86*a* are formed on front surfaces of the walls 83 of the respective five protrusions 82 and the front surfaces of the respective four base walls 81. Each of the plates 86*a* protrudes frontward and extends in the right and left direction. The plates 86*a* are connected to each other so as to form a rib 86 continuously extending from a left end to a right end of the first heat uniforming member 71. This rib 86 improves the stiffness of the first heat uniforming member 71.

As illustrated in FIG. 10, a position of the rib 86 in the up and down direction is the same as positions of the two driver ICs 52 of the COF 21*a* in the up and down direction. With this construction, heat generated by the two driver ICs 52 is more effectively dissipated via the rib 86. Also, the rib 86 continuously extends from the left end to the right end of the first heat uniforming member 71 as described above. In other words, the rib 86 extends in the right and left direction from a position of a left end of the left driver IC 52 of the head unit 11*a* to a position of a right end of the right driver IC 52 of the head unit 11*h*. This construction further reduces difference in temperature among the driver ICs 52 of the COF 21*a* of the eight head units 11.

There will be next explained the second heat uniforming member 72. The second heat uniforming member 72 has a shape formed by rotating the first heat uniforming member 71 by 180 degrees on the horizontal plane about the center of the unit body 20 in the front and rear direction and the right and left direction. In other words, the second heat uniforming member 72 has a shape formed by rotating the first heat uniforming member 71 by 180 degrees about the axis extending through the center of the supporter 12 and perpendicular to the front and rear direction and the right and left direction. This construction enables the first heat uniforming member 71 and the second heat uniforming member 72 to be manufactured in the same process by the same manufacturing device, resulting in reduced manufacturing cost of the first heat uniforming member 71 and the second heat uniforming member 72. For example, in the case where the first heat uniforming member 71 and the second heat uniforming member 72 are manufactured by extrusion molding, a common mold may be used without need for using individual molds for the first heat uniforming member 71 and the second heat uniforming member 72, resulting in manufacturing cost. It is noted that reference numbers obtained by adding ten to the reference numbers of the elements of the first heat uniforming member 71 are used to designate corresponding elements of the second heat uniforming member 72, and an explanation of which is dispensed with.

Like the first heat uniforming member 71, as illustrated in FIG. 2, the second heat uniforming member 72 includes four base walls 91 and five protrusions 92. The four base walls 91 respectively correspond to the rear head units 11*b*, 11*d*, 11*f*, 11*h*. Each of the base walls 91 is located at a rear of a corresponding one of the head units 11. A front surface of each of the base walls 91 faces and is in direct contact with the entire facing surface 61*a* of the flat plate 61 of the individual heat sink 14*b* provided on the corresponding head unit 11.

The five protrusions 92 and the head units 11*b*, 11*d*, 11*f*, 11*h* are arranged in the right and left direction. Left four of the five protrusions 92 respectively correspond to the four head units 11*a*, 11*c*, 11*e*, 11*g*. Each of the five protrusion 92 includes a head-unit-opposed wall 93 and connection walls 95. The head-unit-opposed wall 93 is shaped like a planar plate disposed further toward the front than the base walls 91. The head-unit-opposed wall 93 is parallel with the vertical plane and extends in the right and left direction. Each of the connection walls 95 connects between the head-unit-opposed wall 93 and the base wall 91 adjacent thereto and extends in the front and rear direction. The head-unit-opposed wall 93 of each of the left four protrusions 92 is disposed at a rear of the corresponding head unit 11. A front surface of the head-unit-opposed wall 93 of each of the left four protrusions 92 faces and is in direct contact with a portion of the facing surface 61*a* of the flat plate 61 of the individual heat sink 14*b* of the corresponding head unit 11. Thus, each of the left four protrusions 92 protrudes frontward toward the corresponding head unit 11 and is in thermal contact with the individual heat sink 14*b* provided on the corresponding head unit 11.

In the construction as described above, the second heat uniforming member 72 is in direct contact with the individual heat sinks 14*b* provided on the respective eight head units 11. This construction enables transfer of heat generated by each of the driver ICs 52 of the COFs 21*b* of the head units 11 among the driver ICs 52 via the second heat uniforming member 72 and the individual heat sinks 14*b* provided on the respective head units 11. This heat transfer results in reduced difference in temperature among the driver ICs 52 of the COFs 21*b* of the eight head units 11.

In the present embodiment, the first heat uniforming member 71 and the second heat uniforming member 72 are formed independently of each other and secured to each other so as to be in thermal contact with each other. This construction enables thermal transfer between the first heat uniforming member 71 and the second heat uniforming member 72. This thermal transfer results in reduced difference in temperature between each driver IC 52 of the COFs 21*a* of the eight head units 11 and each driver IC 52 of the COFs 21*b* of the eight head units 11. That is, it is possible to reduce the difference in temperature among all the driver ICs 52 of the ink-jet head 4.

It is noted that a construction for securing the first heat uniforming member 71 and the second heat uniforming member 72 to each other is not limited in particular. In the present embodiment, as described above, the eight head units 11 are arranged along the right and left direction, and the end portions of the unit bodies 20 of the respective two head units 11 disposed next to each other in the right and left direction are located at the same position in the right and left direction. In this construction, in the case where the first heat uniforming member 71 and the second heat uniforming member 72 are secured to each other in a state in which their respective central regions in the right and left direction are in contact with each other, the presence of the head units 11 complicates the construction and may result in smaller contact area. To avoid this problem, in the present embodiment, the first heat uniforming member 71 and the second heat uniforming member 72 are secured to each other at their opposite ends in the right and left direction. Since no head units 11 are disposed between the first heat uniforming member 71 and the second heat uniforming member 72 at their opposite end portions in the right and left direction, the first heat uniforming member 71 and the second heat uniforming member 72 are secured to each other with a relatively large contact area. As a result, it is possible to increase thermal conductivity between the first heat uniforming member 71 and the second heat uniforming member 72.

Specifically, the head-unit-opposed wall 83 of the leftmost protrusion 82 of the first heat uniforming member 71 and the head-unit-opposed wall 93 of the leftmost protrusion 92 of the second heat uniforming member 72 face each other while being in direct contact with each other, and the screw 89 (see FIG. 12) is inserted in the through hole 88*a* formed in the head-unit-opposed wall 83 and the through hole 98*b* formed in the head-unit-opposed wall 93. Likewise, the head-unit-opposed wall 83 of the rightmost protrusion 82 of the first heat uniforming member 71 and the head-unit-opposed wall 93 of the rightmost protrusion 92 of the second heat uniforming member 72 face each other while being in direct contact with each other, and the screw 89 is inserted in the through hole 88*b* formed in the head-unit-opposed wall 83 and the through hole 98*a* formed in the head-unit-opposed wall 93. As described above, the first heat uniforming member 71 and the second heat uniforming member 72 are secured to each other by the screws 89. Accordingly, heat is also transferred between the first heat uniforming member 71 and the second heat uniforming member 72 via the screws 89.

The first heat uniforming member 71 and the second heat uniforming member 72 are formed independently of each other. Thus, the first heat uniforming member 71 may be mounted from a front side of the eight head units 11, and the second heat uniforming member 72 may be mounted from a rear side of the eight head units 11. This construction facilitates assembly of the first heat uniforming member 71 and the second heat uniforming member 72 when compared with a case where the first heat uniforming member 71 and the second heat uniforming member 72 are formed integrally with each other.

The common heat sink 13 is secured to a mount surface 12*a* of the supporter 12 in a state in which a bottom surface of the common heat sink 13 is in contact with the mount surface 12*a*. Since the supporter 12 has relatively high stiffness, the supporter 12 may stably support and secure the common heat sink 13.

Incidentally, when the temperature of the common heat sink 13 becomes high, heat transferred from the common heat sink 13 causes thermal expansion and deformation of the supporter 12. This deformation may cause a deviation of a support position of each head unit 11 from a designed position, leading to deterioration of a quality of an image recorded on the recording sheet 100.

To solve this problem, in the present embodiment, as illustrated in FIGS. 11 and 12, protrusions 87 are respectively formed on bottom surfaces of the respective opposite outermost two protrusions 82 of the first heat uniforming member 71 in the right and left direction. Each of the protrusions 87 has an arc shape protruding downward. The first heat uniforming member 71 is secured to the mount surface 12*a* of the supporter 12 in a state in which only the protrusions 87 are in contact with the mount surface 12*a*. That is, the first heat uniforming member 71 is secured at its opposite ends in the right and left direction to the mount surface 12*a* of the supporter 12 by point contact. Likewise, protrusions 97 each having an arc shape protruding downward are respectively formed on bottom surfaces of respective opposite outermost two protrusions 92 of the second heat uniforming member 72 in the right and left direction. The second heat uniforming member 72 is secured to the mount surface 12*a* of the supporter 12 in a state in which only the protrusions 97 are in contact with the mount surface 12*a*. Here, from the viewpoint of thermal density of the driver ICs 52 of the eight head units 11, the temperature of the common heat sink 13 is lower at its central region in the right and left direction than at its opposite ends in the right and left direction. In the present embodiment, the common heat sink 13 is secured to the mount surface 12*a* in the state in which only the opposite ends of the common heat sink 13 in the right and left direction are in contact with the supporter 12, resulting in reduction of thermal expansion of the supporter 12 due to heat transferred from the common heat sink 13. In addition, since the first heat uniforming member 71 is secured to the supporter 12 by point contact, it is difficult for heat to be transferred from the first heat uniforming member 71 to the supporter 12. Also, in the present embodiment, thermal expansion is less caused in the supporter 12 than in the first heat uniforming member 71. Specifically, the thermal expansion coefficient of the supporter 12 is $10.4\times10^{-6}/°$ C., and the thermal expansion coefficient of the first heat uniforming member 71 is $21\times10^{-6}/°$ C. With the construction described above, even in the case where the temperature of the common heat sink 13 becomes high, the supporter 12 is not easily deformed, thereby preventing deterioration of the recording quality.

Close contact between the common heat sink 13 and the individual heat sinks 14 is important to improve thermal conductivity of each of the head units 11 from the driver ICs 52 to the common heat sink 13. However, in the case where positional misalignment has occurred in each of the head units 11 due to, for example, assembly error, the close contact between the common heat sink 13 and the individual heat sinks 14 may be insufficient. In this regard, in the present embodiment, as described above, the individual heat sink 14 provided on each of the head units 11 is urged outward in the front and rear direction by the elastic members 68*a*, 68*b* and pivotable about the driver ICs 52 as the pivot axis. This construction makes it possible to maintain and improve the close contact between the common heat sink 13 and the individual heat sinks 14. The close contact between the common heat sink 13 and the individual heat sinks 14 will be specifically explained, taking close contact between the individual heat sink 14*a* and the head-unit-opposed wall 83 of the protrusion 82 of the first heat uniforming member 71 as an example.

It is noted that, in the present embodiment, in the state in which each of the individual heat sinks 14*a*, 14*b* is located at the furthest position (see FIG. 7), each of the distance between the base wall 81 and the head-unit-opposed wall 83 in the front and rear direction and the distance between the base wall 91 and the head-unit-opposed wall 93 in the front and rear direction is slightly less than the distance between the flat plates 61 of the respective individual heat sinks 14*a*, 14*b*. Thus, the individual heat sink 14*a* provided on each of the head units 11 receives a load from the first heat uniforming member 71, and accordingly the individual heat sink 14*a* is disposed further toward the rear than the furthest position against the urging force of the elastic member 68*a*. Likewise, the individual heat sink 14*b* provided on each of the head units 11 receives a load from the second heat uniforming member 72, and accordingly the individual heat sink 14*b* is disposed further toward the front than the furthest position against the urging force of the elastic member 68*b*.

In the case where the support position at which the supporter 12 supports the head unit 11 deviates from a predetermined position in the front and rear direction, the distance between the head unit 11 and the first heat uniforming member 71 in the front and rear direction changes. However, since the individual heat sink 14*a* is urged frontward by the elastic member 68*a*, the facing surface 61*a* of the flat plate 61 is moved to a position at which the facing surface 61*a* is in direct contact with the head-unit-opposed wall 83, while keeping the close contact between the individual heat sink 14*a* and the driver ICs 52. That is, the urging force of the elastic member 68*a* can absorb the deviation of the support position of the head unit 11 in the front and rear direction to bring the individual heat sink 14*a* and the first heat uniforming member 71 into direct contact with each other.

As illustrated in FIG. 10, in the case where the head unit 11 is supported by the supporter 12 with inclination in the front and rear direction, the individual heat sink 14*a* is pivoted about the driver ICs 52 of the COF 21*a* as the pivot axis, whereby the facing surface 61*a* of the flat plate 61 is made parallel with the head-unit-opposed wall 83 and brought into contact with the head-unit-opposed wall 83 with close contact between the individual heat sink 14*a* and the driver ICs 52. That is, the pivotal movement of the individual heat sink 14*a* can absorb the inclination of the head unit 11 to bring the individual heat sink 14*a* and the first heat uniforming member 71 into direct contact with each other.

In the present embodiment as described above, even in the event of positional misalignment in each of the head units 11, the urging forces of the elastic members 68*a*, 68*b* keep or improve the close contact between the individual heat sinks 14 and the common heat sink 13 and the close contact between the individual heat sinks 14 and the driver ICs 52. As a result, heat generated by the driver ICs 52 of the head unit 11 can be efficiently transferred to the common heat sink 13 via the individual heat sinks 14*a*, 14*b*, thereby improving a heat dissipation performance of the common heat sink 13.

For each of the head units 11, as in the present embodiment, in the case where the driver ICs 52 are disposed in front of and at a rear of the unit body 20, the individual heat sinks 14 are disposed in front of and at a rear of the unit body 20. With this construction, even in the event of positional misalignment in the head unit 11, heat generated by the driver ICs 52 disposed in front of the unit body 20 is transferred to the common heat sink 13 via the individual heat sink 14*a*, and heat generated by the driver ICs 52 disposed at a rear of the unit body 20 is transferred to the common heat sink 13 via the individual heat sink 14*b*.

While it has been explained that the individual heat sinks 14 can absorb the positional misalignment of the head unit 11, the individual heat sinks 14 in the present embodiment can absorb not only the positional misalignment of the head unit 11 but also positional misalignment of the common heat sink 13 with respect to the head unit 11 and positional misalignment of the COF 21 on which the driver ICs 52 are mounted. That is, even in the case where positional misalignment occurs in at least one of the head units 11, the common heat sink 13, and the COFs 21, the presence of the individual heat sinks 14 provided on each of the head units 11 can absorb the positional misalignment. As a result, heat generated by each of the driver ICs 52 can be transferred to the common heat sink 13 via the individual heat sinks 14.

As described above, each of the head units 11 receives a load from the common heat sink 13 via the individual heat sinks 14. Here, in the case where the common heat sink 13 is firmly secured to the supporter 12 by, e.g., screws, and the support position of the head unit 11 is deviated as described above, for example, a large load may be applied from the common heat sink 13 to the driver ICs 52 of the head unit 11, which may break the driver ICs 52. In addition, a load applied from the common heat sink 13 may deviate the support position at which the supporter 12 supports the head unit 11.

To solve this problem, in the present embodiment, the common heat sink 13 is loosely secured to the mount surface 12*a* of the supporter 12. Specifically, the protrusions 87 of the first heat uniforming member 71 and the protrusions 97 of the second heat uniforming member 72 are secured to the mount surface 12*a* with heat caulking or an adhesive, for example. Thus, the common heat sink 13 is slightly movable with respect to the mount surface 12*a*. This construction enables the common heat sink 13 to be moved to a position at which an excessive load is not applied to each of the head units 11. That is, the common heat sink 13 can be moved to a position at which the elastic forces of the elastic members 68*a*, 68*b* of the eight head units 11 are substantially the same as each other. This movement reduces breakage of the driver ICs 52 and also reduces deviation of the support position at which the supporter 12 supports the head unit 11. It is noted that in the case where the common heat sink 13 is secured to the mount surface 12*a* with an adhesive, the adhesive is preferably formed of a heat insulating material in order to make it difficult for heat to be transferred from the common heat sink 13 to the supporter 12. An elastic member is interposed between the common heat sink 13 and the mount surface 12*a* to loosely secure the common heat sink 13 to the supporter 12. This elastic member is also preferably formed of a heat insulating material in order to make it difficult for heat to be transferred from the common heat sink 13 to the supporter 12.

In the present embodiment as described above, the protrusions 82 of the first heat uniforming member 71 of the common heat sink 13 and the protrusions 92 of the second heat uniforming member 72 of the common heat sink 13 are arranged in accordance with the arrangement of the eight head units 11, enabling the first heat uniforming member 71 and the second heat uniforming member 72 to contact the driver ICs 52 of the eight head units 11 via the individual heat sink 14. This construction reduces the difference in temperature among the driver ICs 52 of the eight head units 11, resulting in reduced deterioration of the recording quality.

It is noted that in the present embodiment, although the first heat uniforming member 71 and the second heat uniforming member 72 are in thermal contact with each other, temperature is different in some degree between the first heat uniforming member 71 and the second heat uniforming member 72. Thus, for example, in the case where the driver ICs 52 of the two head units 11 corresponding to the same ink color are in contact with different heat uniform members via the individual heat sink 14, unevenness in density of the ink color may occur on an image recorded on the recording sheet 100. In the present embodiment, in contrast, all the driver ICs 52 corresponding to the same ink color are in contact with the same heat uniforming member via the individual heat sink 14 in the eight head units 11. For example, each of all the driver ICs 52 corresponding to the black ink color in the eight head units 11 is disposed in front of a corresponding one of the reservoir defining member 33 of a corresponding one of the head units 11 and is in contact with the first heat uniforming member 71 via a corresponding one of the individual heat sinks 14*a*. This construction reliably reduces the difference in temperature among the driver ICs 52 corresponding to the same ink color, thereby reducing a possibility of occurrence of unevenness in density of each ink color.

In the embodiment described above, the ink-jet head 4 is one example of a liquid ejection head. The right and left direction is one example of a first direction. One of the right side and the left side is one example of a third side in the first direction, and the other is one example of a fourth side in the first direction. The front and rear direction is one example of a second direction. The front side is one example of a first side in the second direction, and the rear side is one example of a second side in the second direction. The up and down direction is one example of a third direction. The rear one of the two head units 11 disposed next to each other in the right and left direction is one example of a first head unit, and the front one of the two head units 11 disposed next to each other in the right and left direction is one example of a second head unit. The common heat sink 13 is one example of a heat uniforming unit. The individual heat sink 14*a* is one example of a first individual heat dissipator, and the individual heat sink 14*b* is one example of a second individual heat dissipator. Each of the driver ICs 52 of the COF 21*a* is one example of a first driver IC, and each of the driver ICs 52 of the COF 21*b* is one example of a second driver IC. Each of the protrusions 82 of the first heat uniforming member 71 is one example of a first protrusion, and each of the protrusions 92 of the second heat uniforming member 72 is one example of a second protrusion.

There will be next explained modifications of the above-described embodiment. It is noted that the same reference numerals as used in the above-described embodiment are used to designate the corresponding elements of the modifications, and an explanation of which is dispensed with.

Figure 13:
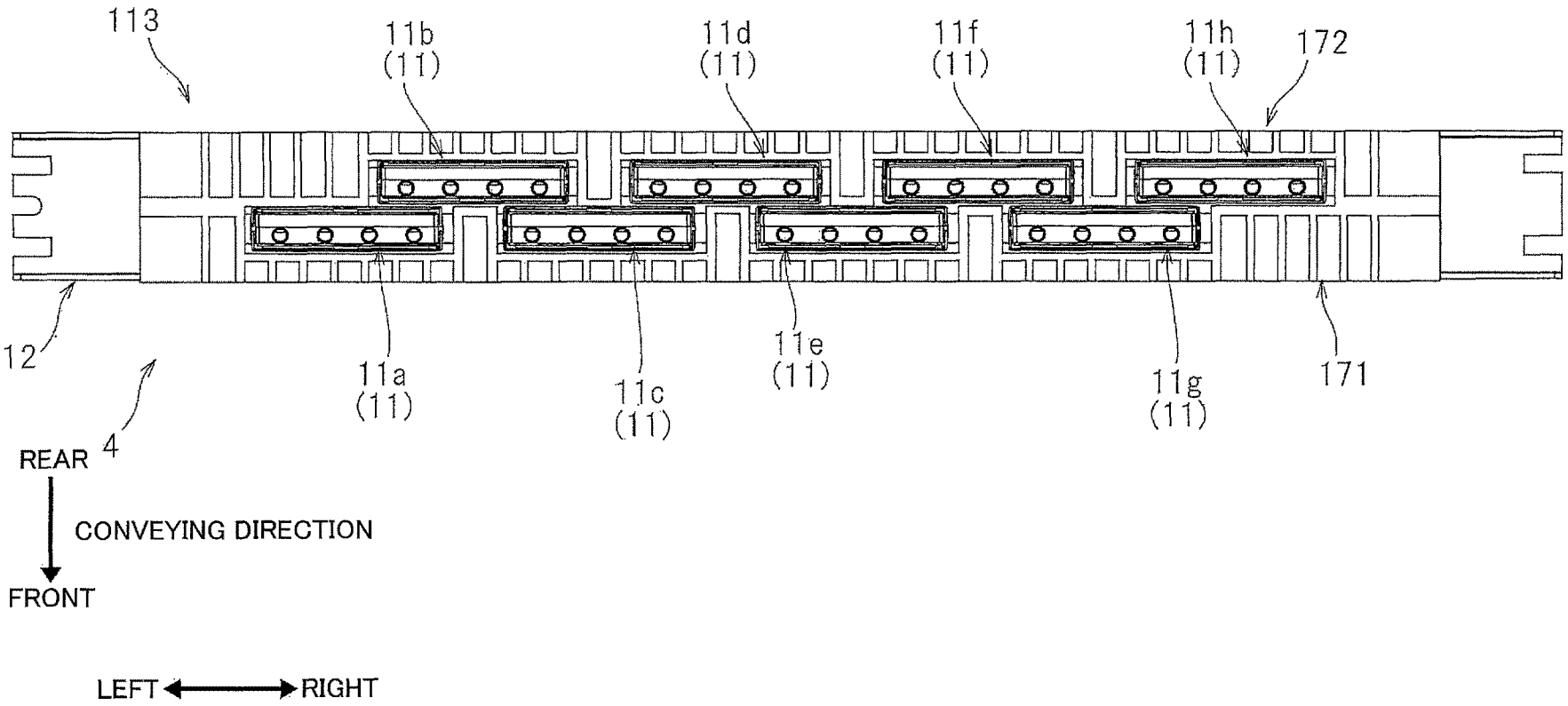
FIG. 13 is a top view of an ink-jet head in a modification.

First, a modification of the common heat sink will be explained. A first heat uniforming member 171 and a second heat uniforming member 172 may be formed integrally with each other as in a common heat sink 113 illustrated in FIG. 13. This common heat sink 113 is the same as the common heat sink 13 except for that the first heat uniforming member and the second heat uniforming member are formed integrally with each other. This common heat sink 113 is secured to the supporter 12 by being installed so as to cover the eight head units 11 supported on the supporter 12. In the construction in which the first heat uniforming member 171 and the second heat uniforming member 172 are formed integrally with each other, an assembling operation is difficult when compared with a construction in which the first heat uniforming member 171 and the second heat uniforming member 172 are formed independently of each other as in the above-described embodiment. However, this modification increases thermal conductivity between the first heat uniforming member 171 and the second heat uniforming member 172. In addition, it is possible to reduce the number of components and eliminate a step of securing the first heat uniforming member 171 and the second heat uniforming member 172 to each other in manufacturing.

Figure 14:
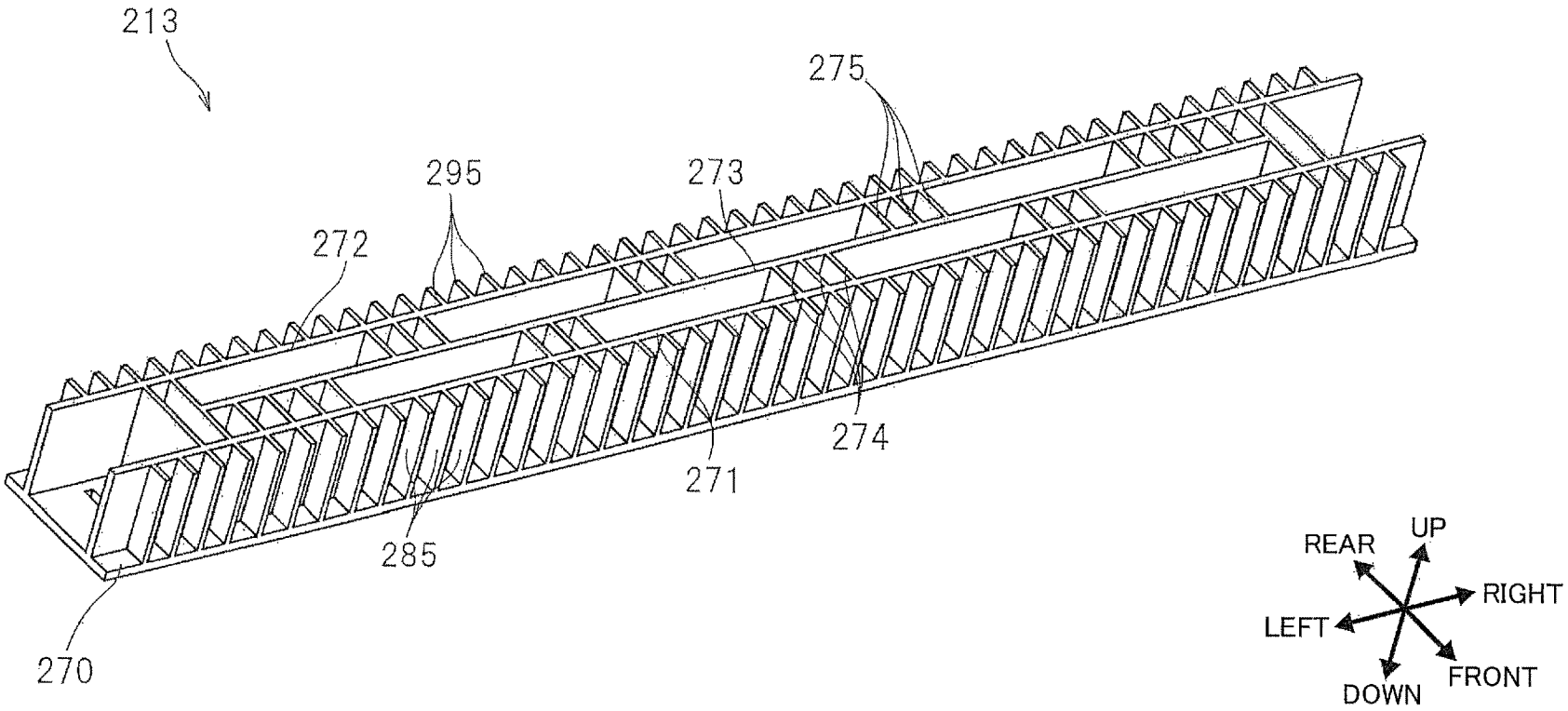
FIG. 14 is a perspective view of a common heat sink in another modification.
Figure 15:
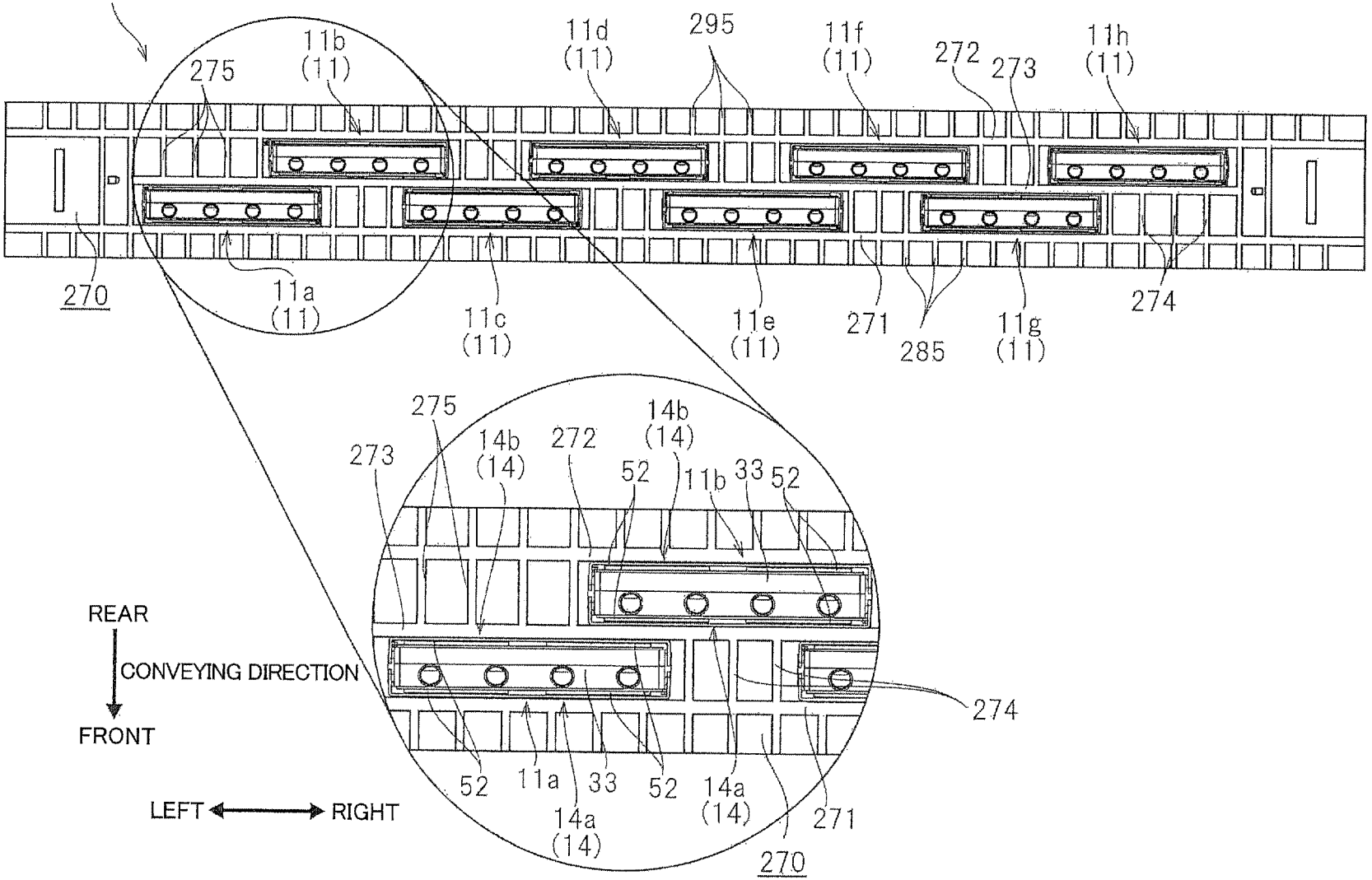
FIG. 15 is a top view of the common heat sink and head units in said another modification.

There will be next explained another modification of the common heat sink with reference to FIGS. 14 and 15. As illustrated in FIGS. 14 and 15, a common heat sink 213 includes a base portion 270, a first heat uniforming member 271, a second heat uniforming member 272, an intermediate heat uniforming member 273, a plurality of first connectors 274, and a plurality of second connectors 275.

The base portion 270 is shaped like a rectangular plate parallel with the horizontal plane and extending in the right and left direction. The base portion 270 has eight through holes, not illustrated, arranged in a staggered configuration so as to correspond to the eight head units 11. Lower portions of the eight head units 11 are inserted in the respective through holes. Each of the first heat uniforming member 271, the second heat uniforming member 272, the intermediate heat uniforming member 273, the plurality of first connectors 274, and the plurality of second connectors 275 is shaped like a plate standing upright on the base portion 270.

The first heat uniforming member 271 is disposed further toward the front than the eight head units 11 and extends in the right and left direction. A rear surface of the first heat uniforming member 271 is in direct contact with the individual heat sinks 14*a* provided on the respective head units 11*a*, 11*c*, 11*e*, 11*g*.

The second heat uniforming member 272 is disposed further toward the rear than the eight head units 11 and extends in the right and left direction. A front surface of the second heat uniforming member 272 is in direct contact with the individual heat sinks 14*b* provided on the respective head units 11*b*, 11*d*, 11*f*, 11*h*.

The intermediate heat uniforming member 273 is disposed further toward the rear than the head units 11*a*, 11*c*, 11*e*, 11*g* and further toward the front than the head units 11*b*, 11*d*, 11*f*, 11*h*. The intermediate heat uniforming member 273 also extends in the right and left direction. A front surface of the intermediate heat uniforming member 273 is in direct contact with the individual heat sinks 14*b* provided on the respective head units 11*a*, 11*c*, 11*e*, 11*g*. A rear surface of the intermediate heat uniforming member 273 is in direct contact with the individual heat sinks 14*a* provided on the respective head units 11*b*, 11*d*, 11*f*, 11*h*.

As illustrated in FIG. 15, the intermediate heat uniforming member 273 is disposed such that its portion is interposed in the front and rear direction between the unit bodies 20 of the respective two head units 11 disposed next to each other in the right and left direction. With this construction, the intermediate heat uniforming member 273 is in contact, via the individual heat sink 14, with the entire surface of the driver IC 52 that is at least partly interposed in the front and rear direction between the unit bodies 20 of the respective two head units 11 disposed next to each other in the right and left direction. As a result, heat of the driver IC 52 is efficiently transferred to the intermediate heat uniforming member 273.

The intermediate heat uniforming member 273 extends at least in the right and left direction from the position of the left end of the left driver IC 52 of the COF 21*b* of the head unit 11*a* to the position of the right end of the right driver IC 52 of the COF 21*a* of the head unit 11*h*. Thus, heat of the driver ICs 52 of the COFs 21*b* of the head units 11*a*, 11*c*, 11*e*, 11*g* and heat of the driver ICs 52 of the COFs 21*a* of the head units 11*b*, 11*d*, 11*f*, 11*h* are efficiently transferred to the intermediate heat uniforming member 273.

A left end portion of each of the first heat uniforming member 271, the second heat uniforming member 272, and the intermediate heat uniforming member 273 is located to the left of the eight head units 11. A right end portion of each of the first heat uniforming member 271, the second heat uniforming member 272, and the intermediate heat uniforming member 273 is located to the right of the eight head units 11. A plurality of heat dissipating fins 285 are formed on a front surface of the first heat uniforming member 271. The heat dissipating fins 285 protrude frontward and extend in the up and down direction. Likewise, heat dissipating fins 295 are formed on a rear surface of the second heat uniforming member 272. The heat dissipating fins 295 protrude frontward and extend in the up and down direction.

The plurality of first connectors 274 are arranged between the first heat uniforming member 271 and the intermediate heat uniforming member 273 at a region at which the head units 11*a*, 11*c*, 11*e*, 11*g* are not disposed. Each of the first connectors 274 extends in the front and rear direction so as to connect between the first heat uniforming member 271 and the intermediate heat uniforming member 273.

The plurality of second connectors 275 are arranged between the second heat uniforming member 272 and the intermediate heat uniforming member 273 at a region at which the head units 11*b*, 11*d*, 11*f*, 11*h* are not disposed. Each of the second connectors 275 extends in the front and rear direction so as to connect between the second heat uniforming member 272 and the intermediate heat uniforming member 273.

In the construction described above, the first heat uniforming member 271, the second heat uniforming member 272, and the intermediate heat uniforming member 273 are in thermal contact with each other via the base portion 270, the plurality of first connectors 274, and the plurality of second connectors 275, enabling heat transfer among the first heat uniforming member 271, the second heat uniforming member 272, and the intermediate heat uniforming member 273. Accordingly, also in the present modification, heat can be transferred among the driver ICs 52 of the eight head units 11 via the common heat sink 213, resulting in reduced difference in temperature among the driver ICs 52.

Figure 16:
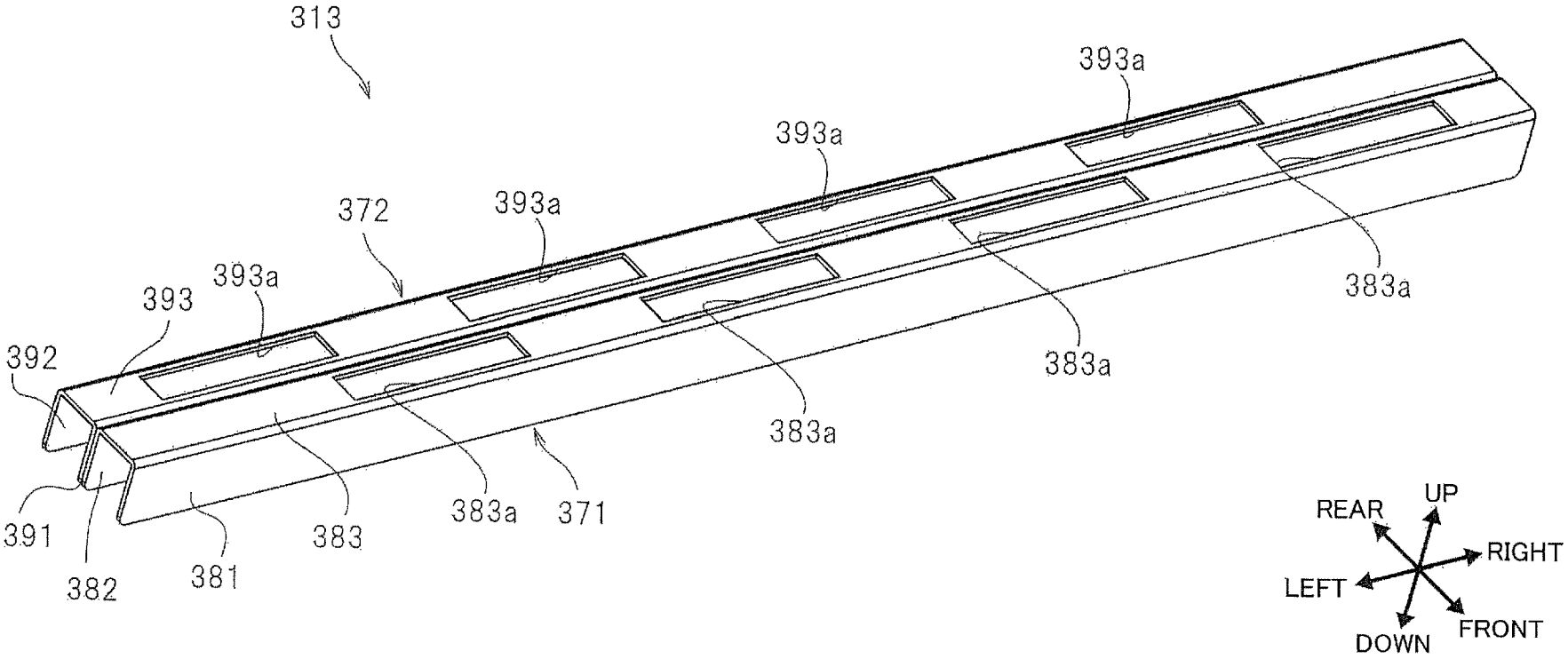
FIG. 16 is a perspective view of a common heat sink in still another modification.

There will be next explained another modification of the common heat sink with reference to FIGS. 16 and 17. As illustrated in FIGS. 16 and 17, a common heat sink 313 includes a first heat sink 371 and a second heat sink 372.

The first heat sink 371 includes a first plate 381, a second plate 382, and a third plate 383. Each of the first plate 381 and the second plate 382 is shaped like a substantially rectangular plate parallel with the vertical plane and elongated in the right and left direction. The first plate 381 and the second plate 382 are arranged side by side in the front and rear direction. The head units 11*a*, 11*c*, 11*e*, 11*g* are interposed between the first plate 381 and the second plate 382 in the front and rear direction. A rear surface of the first plate 381 is in direct contact with the individual heat sinks 14*a* provided on the respective head units 11*a*, 11*c*, 11*e*, 11*g*. A front surface of the second plate 382 is in direct contact with the individual heat sinks 14*b* provided on the respective head units 11*a*, 11*c*, 11*e*, 11*g*.

The third plate 383 is shaped like a substantially rectangular plate parallel with the horizontal plane and elongated in the right and left direction. The third plate 383 connects an upper end of the first plate 381 and an upper end of the second plate 382 to each other. This construction enables heat transfer between the first plate 381 and the second plate 382 via the third plate 383. Four through holes 383*a* are formed through the third plate 383 in the up and down direction so as to correspond to the respective head units 11*a*, 11*c*, 11*e*, 11*g*. The tube connectors 46 and the COF 21*a* of each of the head units 11*a*, 11*c*, 11*e*, 11*g* are inserted in a corresponding one of the through holes 383*a*, for example.

The second heat sink 372 and the first heat sink 371 are substantially the same in construction. Thus, reference numbers obtained by adding ten to the reference numbers of the elements of the first heat sink 371 are used to designate corresponding elements of the second heat sink 372, and an explanation of which is dispensed with.

Like the first heat sink 371, the second heat sink 372 includes a first plate 391, a second plate 392, and a third plate 393. The first plate 391 and the second plate 392 are arranged side by side in the front and rear direction. The head units 11*b*, 11*d*, 11*f*, 11*h* are interposed between the first plate 391 and the second plate 392 in the front and rear direction. A rear surface of the first plate 391 is in direct contact with the individual heat sinks 14*a* provided on the respective head units 11*b*, 11*d*, 11*f*, 11*h*. A front surface of the second plate 392 is in direct contact with the individual heat sinks 14*b* provided on the respective head units 11*b*, 11*d*, 11*f*, 11*h*.

This construction enables heat transfer between the first plate 391 and the second plate 392 via the third plate 393. Four through holes 393*a* are formed through the third plate 393 in the up and down direction so as to correspond to the respective head units 11*b*, 11*d*, 11*f*, 11*h*.

The second plate 382 and the second plate 392 are secured to each other such that a rear surface of the second plate 382 of the first heat sink 371 and the front surface of the second plate 392 of the second heat sink 372 face each other and directly contact each other. It is noted that a method of securing the second plate 382 and the second plate 392 to each other is not limited in particular as long as heat can be transferred between the second plate 382 and the second plate 392. For example, the second plate 382 and the second plate 392 may be fixed to each other with a thermal conductive double-sided tape and may be fastened to each other by screws, with thermal conductive grease interposed between the second plate 382 and the second plate 392. Accordingly, also in the present modification, heat can be transferred among the driver ICs 52 of the eight head units 11 via the common heat sink 313, resulting in reduced difference in temperature among the driver ICs 52, leading to reduced deterioration of the recording quality.

In the present modification, the first plate 381 of the first heat sink 371 is one example of a first heat uniforming member. The second plate 392 of the second heat sink 372 is one example of a second heat uniforming member. Each of the second plate 382 of the first heat sink 371 and the first plate 391 of the second heat sink 372 is one example of an intermediate heat uniforming member.

Any one of the common heat sinks 13, 113, 213, 313 explained above has a shape corresponding to the arrangement of the eight head units 11. That is, each of the common heat sinks 13, 113, 213, 313 includes: a first heat uniforming portion (corresponding to one of the base wall 81, the first heat uniforming member 271, and the first plate 381) located further toward the front than a front one (the first head unit) of the two head units 11 disposed next to each other in the right and left direction; a second heat uniforming portion (corresponding to the head-unit-opposed wall 83, the intermediate heat uniforming member 273, the second plate 382) located further toward the front than a rear one (the second head unit) of the two head units 11 disposed next to each other in the right and left direction and located further toward the rear than the first heat uniforming portion; and a connecting portion (corresponding to the connection wall 84, the first connectors 274, and the third plate 383) connecting the first heat uniforming portion and the second heat uniforming portion to each other. This construction enables each of the common heat sinks 13, 113, 213, 313 to be in contact with the driver ICs 52 of the eight head units 11 via the individual heat sink 14, resulting in reduced difference in temperature among the driver ICs 52 of the eight head units 11.

There will be next explained other modifications.

While the individual heat sinks 14 are supported by the unit body 20 in the above-described embodiment, the present disclosure is not limited to this construction. For example, the individual heat sinks 14 may be supported by the housing 2. Also, the individual heat sink 14 itself may be an elastic material having thermal conductivity. In this construction, the elasticity of the individual heat sinks 14 can absorb deviation of the support position at which the supporter 12 supports the head unit 11. Thus, the elastic members 68*a*, 68*b* are not essential. Each of the individual heat sinks 14 may not be pivotable.

While each of the head units 11 includes the four driver ICs 52, the present disclosure is not limited to this construction. For example, each of the head units 11 may include at least one driver IC 52. The ink-jet head 4 is the ink-jet head capable of ejecting the inks of the four colors but may be an ink-jet head capable of ejecting ink of a single color.

The driver ICs 52 of the eight head units 11 may be disposed on only one of a front side and a rear side of the unit body 20. For example, all the driver ICs 52 of the eight head units 11 may be disposed in front of the unit body 20. In this construction, the common heat sink 13 may include only the first heat uniforming member 71 disposed on a front side with respect to the eight head units 11. Also, each of the head units 11 may be provided with only the individual heat sink 14*a*.

The individual heat sink 14*b* has a shape formed by rotating the individual heat sink 14*a* by 180 degrees on the horizontal plane about the center of the unit body 20 in the front and rear direction and the right and left direction in the above-described embodiment, but the individual heat sink 14*a* and the individual heat sink 14*b* may be different from each other in shape. Also, the individual heat sink 14*a* and the individual heat sink 14*b* may be symmetrical with respect to a horizontal plane parallel with the right and left direction and perpendicular to the front and rear direction.

While each of the driver ICs 52 has a rectangular parallelepiped shape in the above-described embodiment, the present disclosure is not limited to this construction. For example, each of the driver ICs 52 may be shaped like a cube. While each of the individual heat sinks 14 is pivotable about the longitudinal direction of the corresponding driver ICs 52 as the pivot axis in the above-described embodiment. Each of the individual heat sinks 14 may be pivotable about a direction intersecting the longitudinal direction of the driver ICs 52 as the pivot axis as long as each of the individual heat sinks 14 pivots about the driver ICs 52.

The number of the head units 11 is not limited as long as two or more head units 11 are provided. The individual heat sinks 14 are not essential, and each of the common heat sinks 13, 113, 213, 313 may be in direct contact with the driver ICs 52.

In the above-described embodiment, the ink-jet head 4 is a line head which does not move with respect to the recording sheet 100 during image recording. In contrast, the ink-jet head 4 may be a serial head configured to eject ink while moving with respect to the recording sheet 100 in its widthwise direction.

The present disclosure is applied to the ink-jet head configured to eject the ink onto the recording sheet to record an image or other information in the above-described embodiment but may be applied to a liquid ejection head used for purposes different from the recording of the image or other information. For example, the present disclosure may be applied to a liquid ejection head configured to eject conductive liquid onto a substrate to form a conductive pattern on a surface of the substrate.

What is claimed is:

1. A liquid ejection head, comprising:

a first head unit;

a second head unit disposed adjacent to the first head unit in a first direction, the second head unit located on a first side of the first head unit in a second direction orthogonal to the first direction; and a metal cover, the first head unit and the second head unit each comprising:

a unit body comprising an actuator configured to cause ejection of liquid from a plurality of nozzles; and a first driver disposed on the first side of the unit body in the second direction, the first driver being configured to drive the actuator, the metal cover comprising:

a first metal member disposed on the first side of the first head unit and the second head unit in the second direction; and an intermediate metal member disposed on the first side of the first head unit in the second direction and disposed on a second side of the second head unit in the second direction, the first side and the second side being opposite sides in the second direction, the first metal member and the intermediate metal member being formed integrally with each other, a first connector being disposed at a region at which the second head unit is not disposed in a region located between the intermediate metal member and the first metal member, the first connector extending in the second direction, the first connector and the second head unit being arranged in the second direction, the first connector connecting the intermediate metal member and the first metal member to each other.

2. The liquid ejection head according to claim 1, wherein a plurality of first connectors each as the first connector are arranged respectively on opposite sides of the second head unit in the first direction.

3. The liquid ejection head according to claim 1, wherein each of the first head unit and the second head unit comprises a second driver disposed on the second side of the unit body in the second direction and configured to drive the actuator, wherein the metal cover comprises a second metal member disposed on the second side of the first head unit and the second head unit in the second direction, and wherein the first metal member, the intermediate metal member, and the second metal member are formed integrally with each other.

4. The liquid ejection head according to claim 3, wherein a second connector is disposed at a region at which the first head unit is not disposed in a region located between the intermediate metal member and the second metal member, and wherein the second connector extends in the second direction, the second connector and the first head unit being arranged in the first direction, the second connector connecting the intermediate metal member and the second metal member to each other.

5. The liquid ejection head according to claim 4, wherein a plurality of second connectors each as the second connector are arranged respectively on opposite sides of the first head unit in the first direction.

6. The liquid ejection head according to claim 1, wherein an end portion of the unit body of the first head unit and an end portion of the unit body of the second head unit which are adjacent to each other in the first direction are located at an identical position in the first direction, and wherein at least a portion of the first driver of the first head unit is disposed between the unit body of the first head unit and the unit body of the second head unit in the second direction.

7. The liquid ejection head according to claim 6, wherein at least a portion of the intermediate metal member is disposed between the unit body of the first head unit and the unit body of the second head unit in the second direction.

8. The liquid ejection head according to claim 7, wherein the intermediate metal member extends in the first direction from a position of one of opposite end portions of the first driver of the first head unit, which one is further from the second head unit in the first direction than the other of the opposite end portions of the first driver of the first head unit, to a position of one of opposite end portions of the second driver of the second head unit, which one is further from the first head unit in the first direction than the other of the opposite end portions of the second driver of the second head unit.

* * * * *